US006078346A

United States Patent [19]

Isobe et al.

[11] Patent Number: 6,078,346

[45] Date of Patent: Jun. 20, 2000

[54] IMAGE FORMING APPARATUS

[75] Inventors: Minoru Isobe; Noboru Otaki, both of Tokyo, Japan

[73] Assignee: Oki Data Corporation, Tokyo, Japan

[21] Appl. No.: 08/964,886

[22] Filed: Nov. 5, 1997

[30] Foreign Application Priority Data

Nov. 7, 1996 [JP] Japan ..... 8-294786

[51] Int. Cl.[7] ..... B41J 11/00

[52] U.S. Cl. ..... 347/218; 347/172; 399/2

[58] Field of Search ..... 347/218, 3, 172, 347/174, 176; 271/277, 82, 204; 400/120.02, 120.04; 399/2, 139

[56] References Cited

U.S. PATENT DOCUMENTS

| | | | |
|---|---|---|---|
| 4,999,649 | 3/1991 | Saji et al. | 347/218 |
| 5,168,286 | 12/1992 | Okauchi et al. | 347/222 |
| 5,206,695 | 4/1993 | Iwata | 399/379 |
| 5,220,342 | 6/1993 | Moriyama | 347/43 |
| 5,362,043 | 11/1994 | Grellman | 271/277 |
| 5,555,462 | 9/1996 | Fukumoto et al. | 347/218 |
| 5,790,915 | 8/1998 | Arcaro et al. | 399/2 |
| 5,847,742 | 12/1998 | Nishimura | 347/173 |
| 5,898,452 | 4/1999 | Sasaki et al. | 347/219 |

*Primary Examiner*—N. Le
*Assistant Examiner*—Shih-Wen Hsieh
*Attorney, Agent, or Firm*—Rabin & Champagne, P.C.

[57] ABSTRACT

A medium transporting mechanism is used in a color image forming apparatus and a color image reading apparatus. The medium transporting mechanism includes a medium holding section and a rotary transporting section. The medium holding section holds a print-medium by clamping the leading end of the print-medium. The rotary transporting section supports the medium holding section thereon and rotates so that the medium holding section travels around a platen in such a manner that the print-medium slides on at least a part of the platen and the medium holding section travels in a loop-like path which is shorter than a maximum dimension of the print-medium in a direction of travel of the print-medium. A color image recording section is located to oppose the platen so that a print-medium passes between the color image recording section and the platen. The color image recording section prints images of yellow, magenta, cyan in sequence and in register on the print-medium. A monochrome image recording section such as an electrophotographic printer may be provided in addition to the color image recording apparatus. The electrophotographic printer prints a black image only. When printing a color image, the electrophotographic printer prints a black image at a high speed and the color image recording section prints images of other colors such as yellow, magenta, and cyan at a slow speed, thereby speeding up overall printing speed in color printing operation.

29 Claims, 23 Drawing Sheets

IMAGE FORMING APPARATUS

FIELD OF THE INVENTION

The present invention relates to a color image forming apparatus which prints images of a plurality of different colors in superposition on a print-medium, and more particularly to an image forming apparatus having an improved medium transporting mechanism.

DESCRIPTION OF RELATED ART

One of conventional color image forming apparatuses is an apparatus in which a color image is printed on a sheet recording medium by moving the recording medium a plurality of times back and forth about a print head (first related art). One such apparatus is a thermal transfer printer. With this type of apparatus, a thermal head transfers ink of respective colors onto a recording medium using an ink sheet with four colored inks, i.e., yellow, magenta, cyan, and black. An image of yellow is printed on the recording medium while moving the recording medium forwardly. When the image of yellow has been printed, the recording medium is returned to its home position. Then, an image of magenta is printed over the yellow image while moving the recording medium forwardly. Similar operations are performed for cyan and black images to form a full color image. Since the recording medium is moved back and forth many times, a registration problem of images of the respective colors may occur.

This registration problem is overcome by another conventional image forming apparatus in which a recording medium is wrapped around a cylindrical drum and a thermal head is pressed to the recording medium. The thermal head is driven in accordance with the print data, the drum being rotated back to its home position after having printed an image of a corresponding color. It takes some time for the drum to return to its home position for printing an image of the next color, requiring a long time for printing a color image (second related art).

However, the aforementioned first related art requires that the recording medium is moved back to its home position with respect to the print head after an image of one color has been printed and be moved forward again for printing an image of the next color. It is difficult to accurately move the recording medium back to the home position, leading to misregistration of images of different colors. In addition, it takes some time for the recording medium to return to its home position.

The second related art needs a drum having a diameter such that the largest recording medium may be wrapped around it without the leading end and trailing end of the recording medium being overlapped. Thus, the drum is necessarily large in size and therefore the overall apparatus becomes bulky.

SUMMARY OF THE INVENTION

An object of the present invention is to provide a print-medium transporting mechanism for use in a color image forming apparatus and an image input and output apparatus.

Another object, of the present invention is to provide an image forming apparatus which solves registration problem with a prior art color image forming apparatus.

Still another object of the invention is to provide an image forming apparatus capable of printing a color image at high speed.

A print-medium transporting mechanism is used in a color image forming apparatus and a color image scanning apparatus. The print-medium transporting mechanism includes a medium holding section and a rotary transporting section. The medium holding section holds a medium by clamping the leading end of the medium. The rotary transporting section supports the medium holding section thereon and rotates so that the medium holding section travels around a platen in such a manner that the print-medium slides on at least a part of the platen and the medium holding section travels in a loop-like path which is shorter than a maximum dimension of the print-medium in a direction of travel of the print-medium. The loop-like path may be a circular path eccentric or concentric with the platen. Alternatively, the loop-like path may be a noncircular path.

A guide member defines a space which accommodates a slack produced in the print-medium when the print-medium has a length greater than the loop-like path.

A color image recording section is located to oppose the platen so that a print-medium passes between the color image recording section and the platen. The color image recording section prints images of yellow, magenta, cyan in sequence and in register on the print-medium.

A monochrome image recording section such as an electrophotographic printer may be provided in addition to the color image recording apparatus. The electrophotographic printer prints a black image at a high speed the color image recording section prints images of other colors such as yellow, magenta, and cyan at a slow speed, thereby speeding tip overall printing speed in color printing operation.

An image scanner may be located to oppose another part of the platen where an original slides over the platen. The print-medium passes between the image scanner and the platen.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWING

The present invention will become more fully understood from the detailed description given hereinbelow and the accompanying drawings which are given by way of illustration only, and thus are not limitative of the present invention, and wherein.

DETAILED DESCRIPTION OF THE INVENTION

Preferred embodiments of the present invention will be described in detail with reference to the drawings.

First Embodiment

<Construction>

Figure 1:
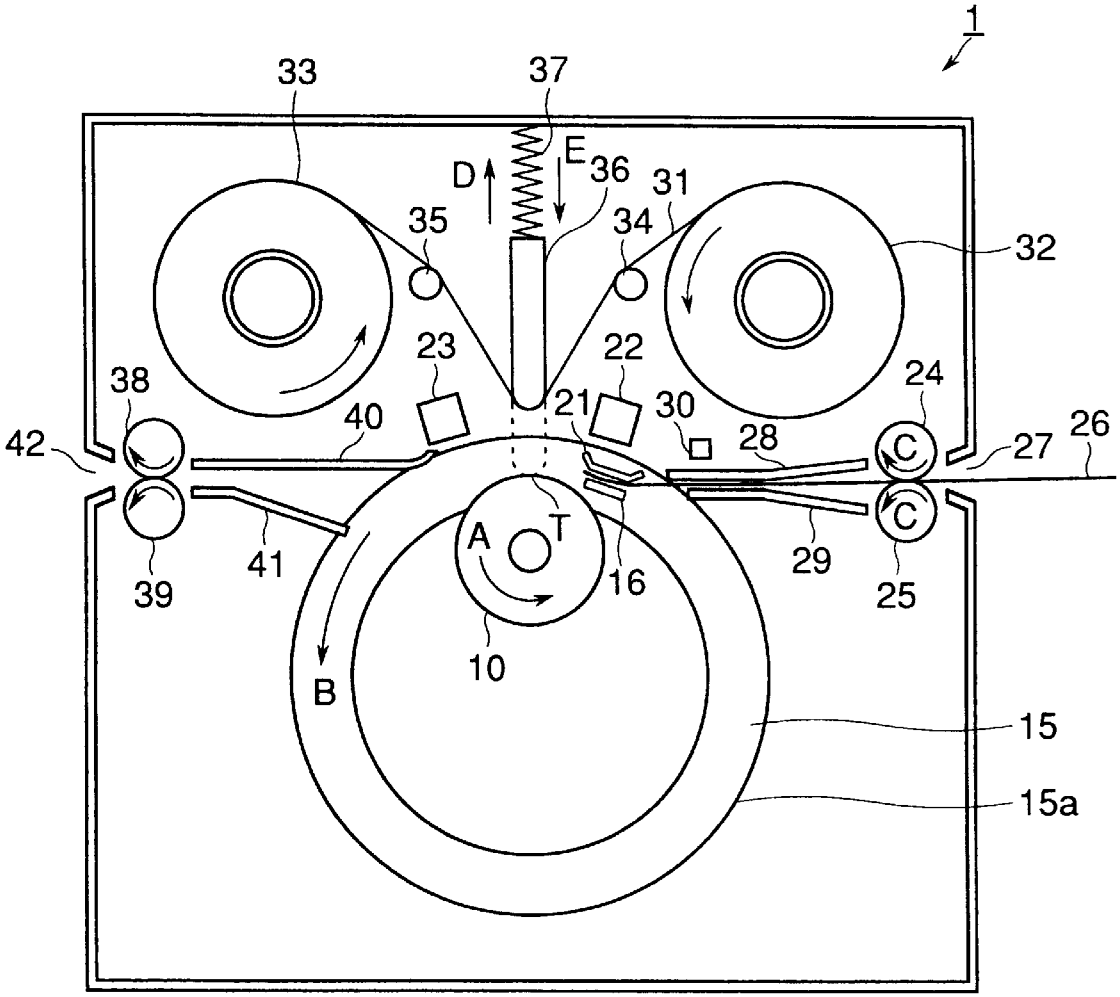
FIG. 1 is a side view of a first embodiment of a color image forming apparatus according to the invention.
Figure 2:
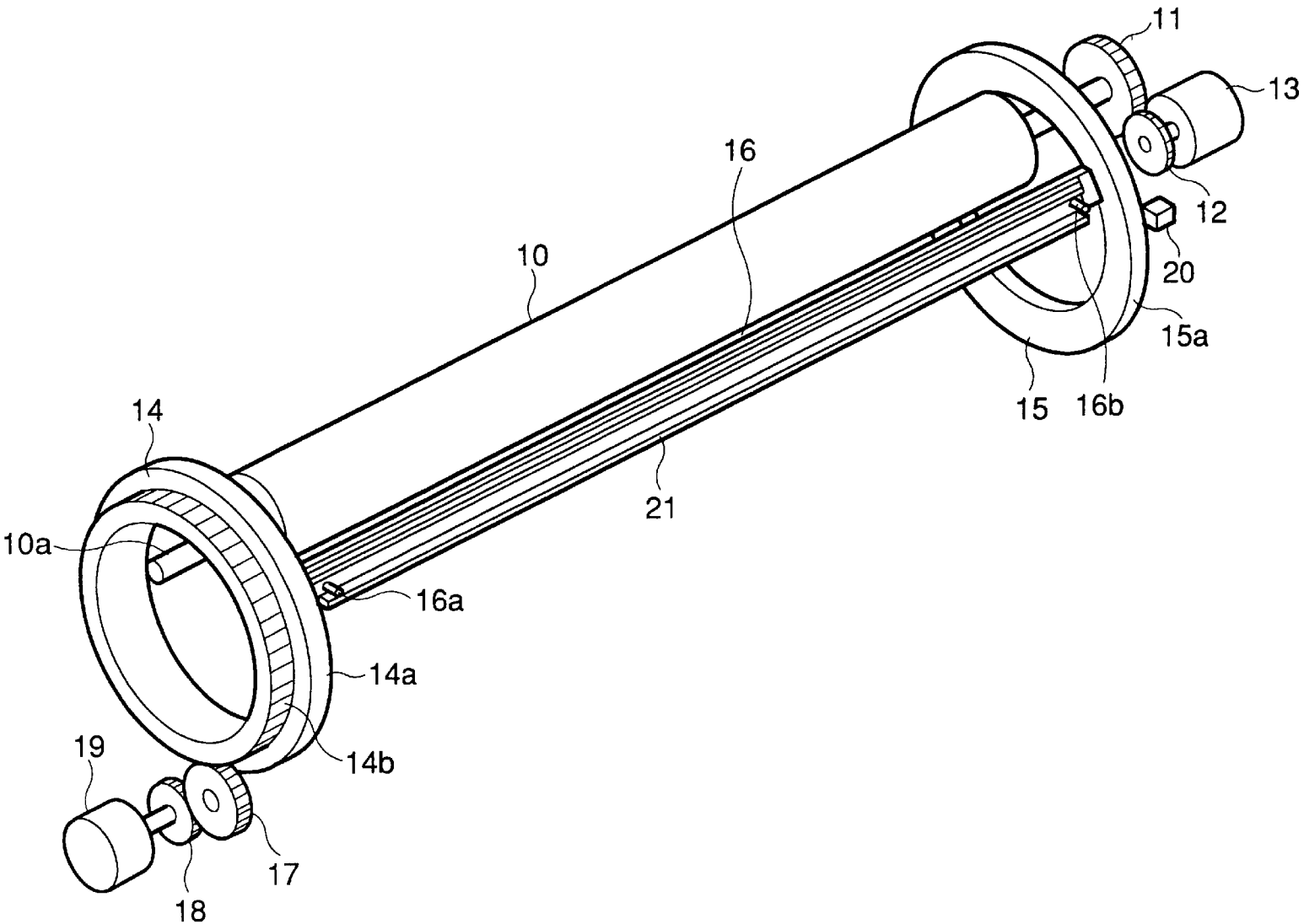
FIG. 2 is a perspective view showing a relevant portion of the first embodiment.

FIG. 1 is a side view of a first embodiment of a color image forming apparatus according to the invention, showing a later described movable clamp member 21 at its home position. FIG. 2 is a perspective view showing a relevant part of the first embodiment.

Referring to FIGS. 1 and 2, a color image forming apparatus 1 includes a platen 10 rotatably mounted on a shaft 10*a* to which a platen gear 11 is mounted. The platen gear 11 is in mesh with a motor gear 12 secured to a shaft of a platen motor 13. When the platen motor 13 rotates, the platen 10 rotates in a direction shown by arrow A.

Rings 14 and 15 are rotatably mounted near the longitudinal ends of the platen 10. A fixed clamp member 16 extends between the rings 14 and 15. The longitudinal ends of the fixed clamp member 16 are fixed to the inner sides of the rings 14 and 15. The outer sides 14*a* and 15*a* of the rings 14 and 15 are supported by bearings, not shown, so that the rings 14 and 15 are rotatable in a direction shown by arrow B. The ring 14 is formed with a gear 14*b* on its outer circumference. The gear 14*b* is in mesh with an idle gear 17 which in turn is in mesh with the motor gear 18. When the motor 19 rotates, the rings 14 and 15 and fixed clamp member 16 travels in the direction shown by arrow B. The shaft 10*a* of the platen 10 extends through the inner space of the rings 14 and 15 and is rotatably supported by the bearings, not shown, at an area where the shaft project outwardly of the rings 14 and 15.

A home sensor 20 is provided beside the ring 15 outside of an area defined between the rings 14 and 15. The home sensor 20 takes the form of a reflection type photosensor which detects a home mark provided on the side surface of the ring 15, thereby detecting that the ring 15 is at the home position of the rings 14 and 15.

The fixed clamp member 16 cooperates with a movable clamp member 21 to hold a print-medium 26 therebetween. The movable clamp member 21 is urged by a spring, not shown, toward the fixed clamp member 16 and is guided by guides 16*a* and 16*b* provided on the fixed clamp member 16. Clamp driving mechanisms 22 and 23 are disposed to oppose the movable clamp member 21. Each of the clamp driving mechanisms 22 and 23 includes an electromagnet and causes the movable clamp member 21 to move into or out of contact engagement with the fixed clamp member 16. When the electromagnets are energized, the electromagnets attract the movable clamp member 21 to separate the movable clamp member 21 from the fixed clamp member 16. Thus, a small gap is created between the movable clamp member 21 and the fixed clamp member 16, being wide enough for the print-medium 26 to enter. When the electromagnets are deenergized, the movable clamp member 21 is urged against the fixed clamp member 16 into contact engagement with the fixed clamp member 16. Thus, the print-medium 26 cannot enter between the movable clamp member 21 and the fixed clamp member 16.

Feeding rollers 24 and 25 are rotatably mounted on the right side of the color image forming apparatus 1 in FIG. 1. When the print-medium 26 is inserted into a print-medium entrance 27, the feeding rollers 24 and 25 are driven by a motor, not shown, to rotate in a direction shown by arrows C so as to feed the print-medium 26 into the apparatus 1. The print-medium 26 is then guided between guides 28 and 29 into the gap between the movable clamp member 21 and fixed clamp member 16. A sensor 30 in the form of a photosensor is located over the guide 28 and detects the leading end and trailing end of the print-medium 26 when the print-medium 26 is advanced between the guides 28 and 29.

Figure 3:
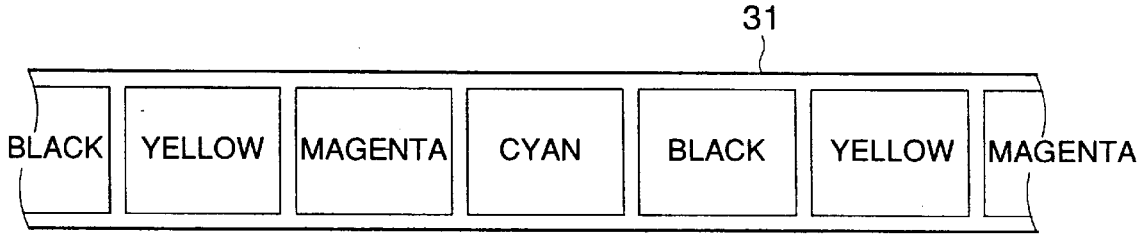
FIG. 3 illustrates an ink ribbon for use in the first embodiment.

FIG. 3 illustrates an ink film ribbon 31.

An Ink film supply reel 32 and an ink film take-up reel 33 are disposed over the path of the print-medium 26, and an ink film ribbon 31 rides on the reels 32 and 33. The ink film ribbon 31 is made of a very thin plastic film on which ink layers of yellow, magenta, cyan, and black are aligned as shown in FIG. 3 in such a way that each ink layer containing pigment or dye of the color to be printed extends over an area of one page of the print-medium 26 and is somewhat longer than the print-medium. The ink layers of the respective colors are aligned on a one-color-on-a-page basis. The ink film ribbon 31 may have layers of only three colors, i.e., yellow, magenta, and cyan. The ink film ribbon 31 is guided by guide rollers 34 and 35 which are rotatably supported and disposed between the reels 32 and 33.

A thermal head 36 is disposed immediately over the platen 10. The thermal head 36 is of a surface type having a plurality of light emitting elements aligned in line. The light emitting elements are energized to radiate heat which fuses or sublimates the ink material in the ink layers of the ink film ribbon 31, thereby thermally transferring the ink to the print-medium 26 to form a color image. The thermal head 36 is driven by an up/down mechanism, not shown, to move in a direction shown by arrow E or in a direction shown by arrow D so that the thermal head 36 moves into or out of pressure contact engagement with the platen 10 at an area T.

Guides 40 and 41 are disposed downstream of the thermal head 36 and discharge rollers 38 and 39 are disposed on the left side of the apparatus 1. The print-medium 26 passes between the guides 40 and 41 to the discharge rollers 38 and 39 which discharge the print-medium 26 through a print-medium exit 42.

Figure 4:
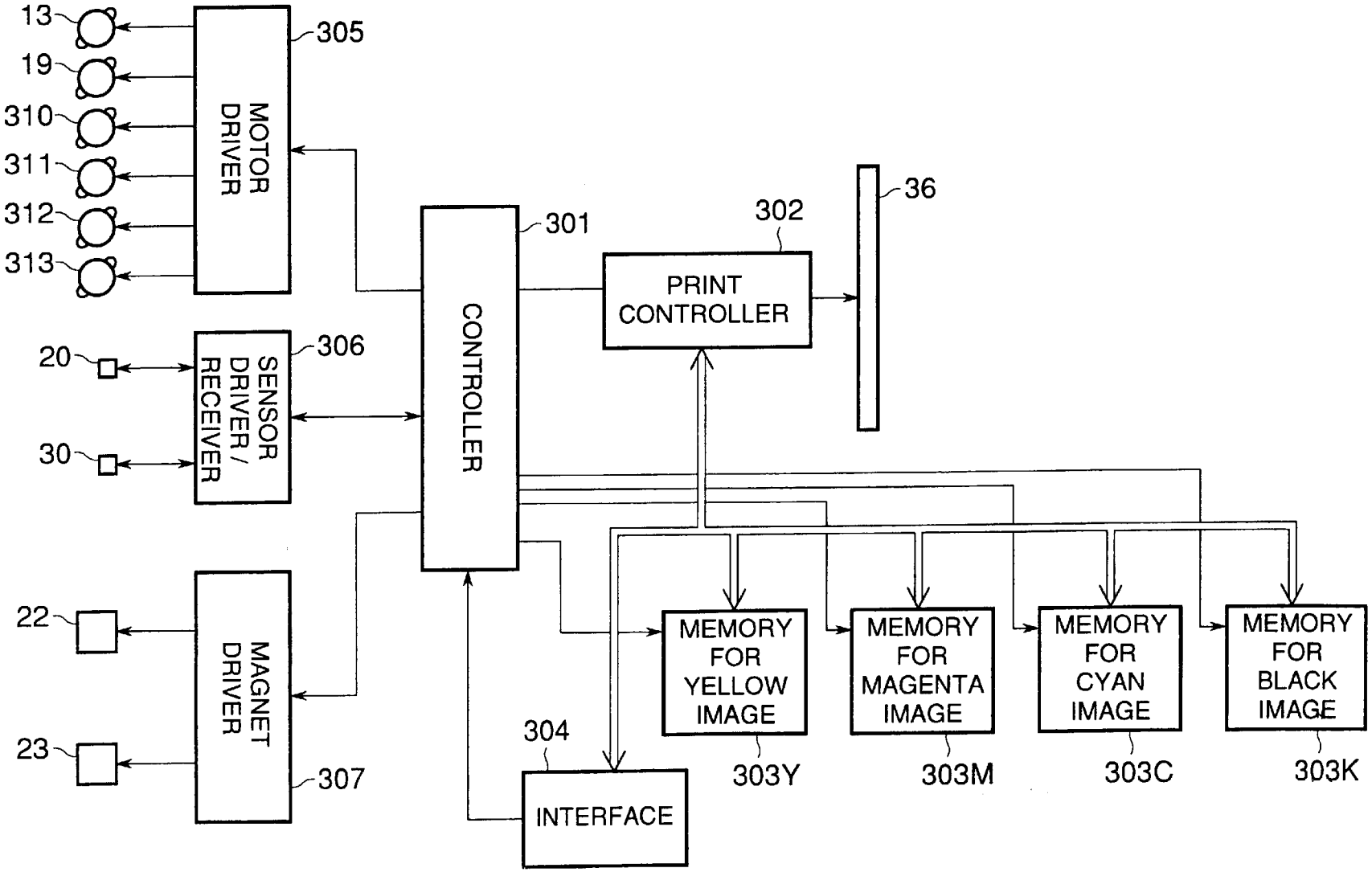
FIG. 4 is a timing chart illustrating the operation of the first embodiment.

FIG. 4 is a block diagram illustrating the control system of the first embodiment. A main controller 301 is for example, a microprocessor and controls the overall operation of the color image forming apparatus 1.

The controller 301 is connected to a print controller 302 which controls the thermal head 36 in accordance with the print data. The print controller 302 receives image data from memories 303Y, 303M, 303C, and 303K and sends the received data to the thermal head 36 via the print controller 302. The print controller 302 operates under the control of the controller 301 to vary the time during which the light emitting elements are energized, thereby fusing the ink of the ink film ribbon 31 to print a color image on the print-medium 26. The memories 303Y, 303M, 303C, and 303K store the image data received via an interface 304 from an external apparatus, e.g., a host computer.

The interface 304 separates the image data according to color and stores yellow data, magenta data, cyan data, and black data into the memories 303Y, 303M, 303C, and 303K, respectively.

The motor driver 305 controls the feeding motor 310, platen motor 13, ring motor 19, ribbon motor 311, head up/down motor 312, and discharge motor 313. The feeding motor 310 drives the feeding rollers 24 and 25 in rotation. The ring motor 19 drives the rings 14 and 15 and fixed clamp member 16 in rotation. The platen motor 13 drives the platen 10 in rotation in the direction shown by arrow A. The ribbon motor 311 feeds the ink film ribbon 31 from the ink film supply reel 32 to the ink film takeup reel 33. The head up/down motor 312 moves the thermal head 36 in the directions shown by arrow E and D. The discharge motor 313 drives the discharge rollers 38 and 39 in rotation.

The rollers driven by the aforementioned motors are linked by belts or gears, not shown. A sensor receiver/driver 306 drives the home sensor 20 and sensor 30 and receives the outputs of these sensors and sends the received outputs to the controller 301. The magnet driver 307 energizes and deenergizes the electromagnets of the clamp driving mechanisms 22 and 23 to activate and deactivate the movable clamp member 21.

<Operation>

Figure 6:
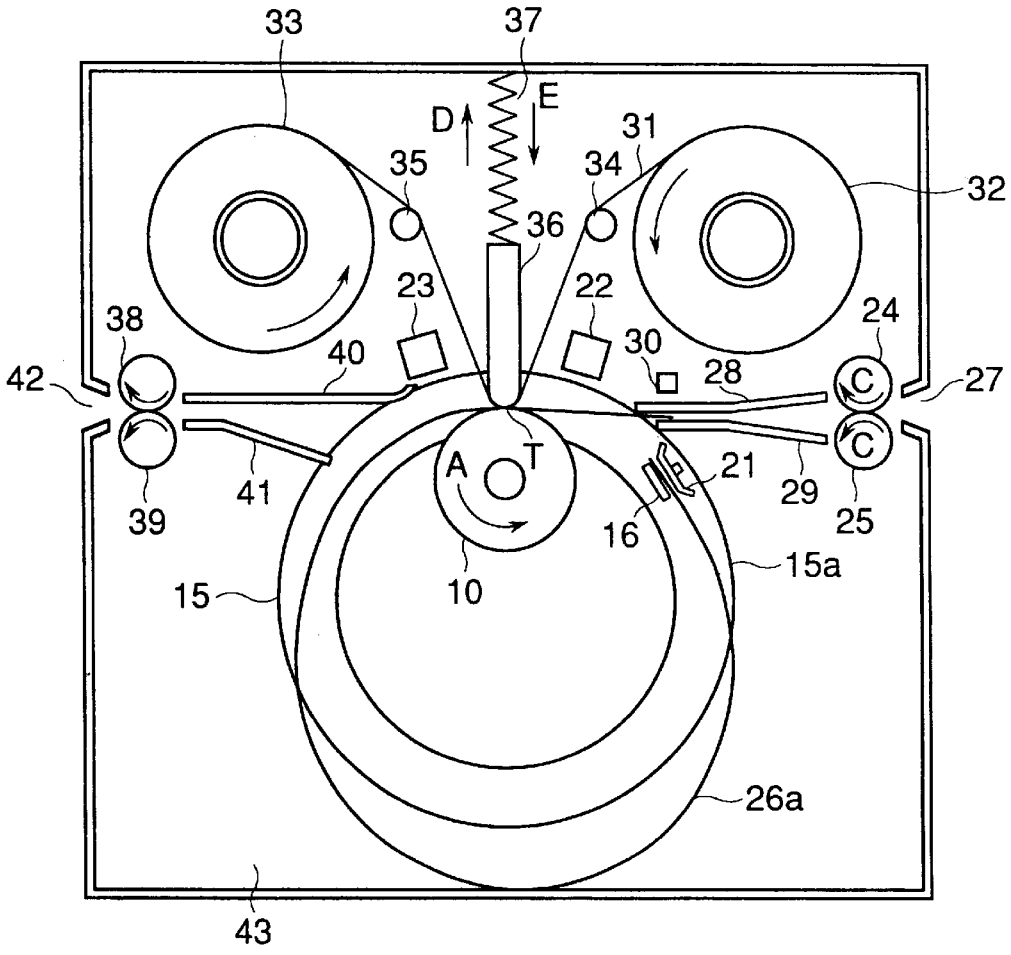
FIG. 6 is a side view of the apparatus according to a first embodiment.
Figure 7:
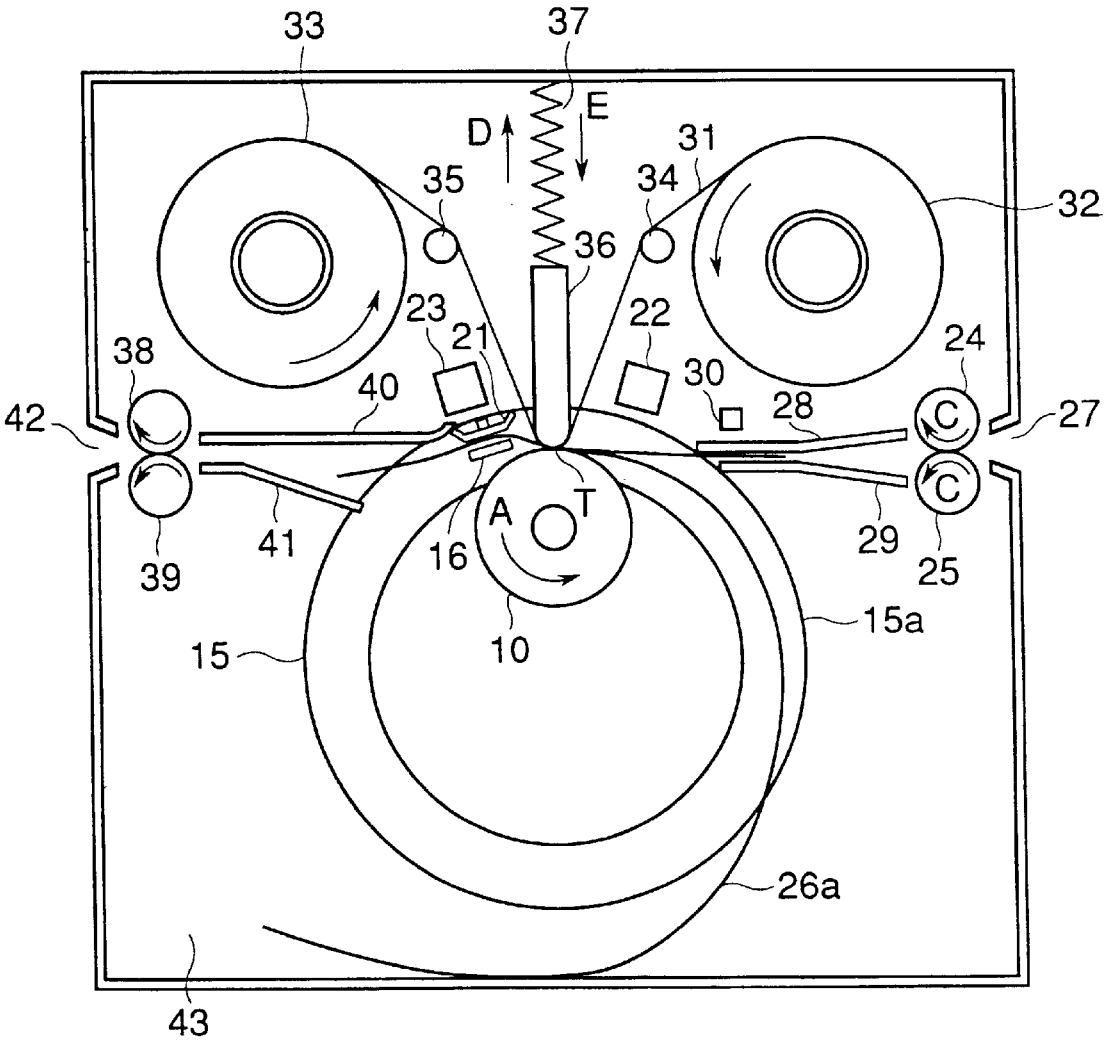
FIG. 7 is side view of the apparatus according to the first embodiment.

The operation of the first embodiment will now be described with reference to FIGS. 6 and 7 and the timing chart in FIG. 5. FIGS. 6 and 7 are side views of the apparatus 1 according to the first embodiment. The operation will be described with respect to printing operation of a color image.

Figure 5:
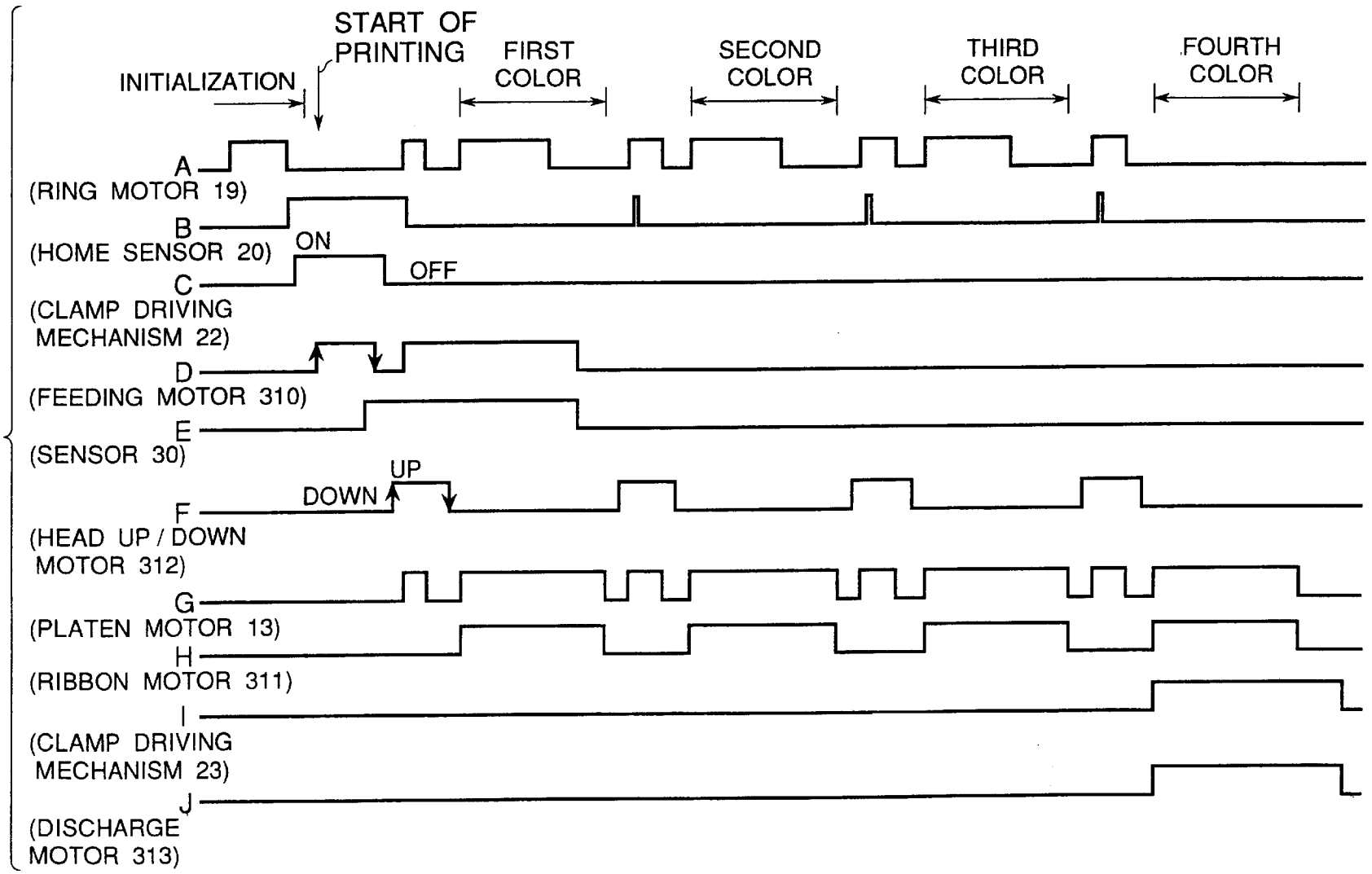
FIG. 5 is a block diagram illustrating the control system of the first embodiment.

Upon power-on, the controller 301 causes the motor driver 305 to drive the ring motor 19 as described by waveforms A and B shown in FIG. 5, so that the rings 14 and 15, fixed clamp member 16, and movable clamp member 21 rotate in the direction shown by arrow B and stop at a home position where the fixed clamp member 16 and movable clamp member 21 are immediately under the clamp driving mechanism 22 and the home sensor 20 detects the home mark on the ring 15. The controller 301 causes the magnet driver 307 to activate the clamp driving mechanism 22 as depicted by waveform C so that the clamp 21 moves away from the fixed clamp member 16 to create a gap between the fixed clamp member 16 and movable clamp member 21. This completes initialization of the apparatus 1 and the apparatus waits for image data which will be supplied via the interface 304 from the host computer. Upon receiving the image data, the controller 301 outputs instructions to the interface 304, memories 303Y, 303M, 303C, and 303K. In response to the instructions, the interface 304 separates the receive image data into the respective colors, and stores image data of each color into a corresponding memory. Each of the memories 303Y, 303M, 303C, and 303K stores image data of the corresponding color for one page of print-medium 26.

The controller 301 causes the motor driver 305 to drive a feeding motor 310, thereby rotating the feeding rollers 24 and 25 in the directions shown by arrow C in order to pull in the print-medium 26 inserted into the print-medium entrance 27. The medium sensor 30 detects the leading end of the print-medium 26. The controller 301 then allows the print-medium 26 to further travel a predetermined distance into the apparatus 1 so that the print-medium 26 enters a gap between the fixed clamp member 16 and the movable clamp member 21. When the leading end of the print-medium 26 enters the gap, the controller 301 causes the feeding motor 310 to halt, thus the feeding rollers 24 and 25 being halted. The controller 301 causes the magnet driver 307 to deactivate the clamp driving mechanism 22 so that the leading end of the print-medium 26 is clamped. Thereafter, the controller 301 causes the motor driver 305 to drive the head up/down motor 312, thereby moving the thermal head 36 in the direction shown by arrow D to a solid line position in FIG. 1 as depicted by waveform F. Then, the controller 301 causes the motor driver 305 to drive the feeding motor 310 so that the feeding rollers 24 and 25 rotate in the direction shown by arrow C, and the platen motor 13 and ring motor 19 to drive the platen 10 and rings 14 and 15 in rotation in the directions shown by arrows A and B, respectively, as depicted by waveforms D and B. As soon as the movable clamp member 21 arrives at the area immediately under the clamp driving mechanism 23, the controller 301 causes the motor driver 305 to stop the ring motor 19. The controller 301 causes the motor driver 305 to drive the head up/down motor 312 so that the thermal head 36 is moved in the direction shown by arrow E to a dotted line position shown in FIG. 1 as depicted by waveform F, thereby causing the heat generating elements of the thermal head 36 to be in pressure contact with the platen 10 via the ink film ribbon 31. The controller 301 then causes the motor driver 305 to drive the ribbon motor 311 so as to supply the ink film ribbon 31 from the ink film supply reel 32 to the ink film takeup reel 33 as depicted by waveform H. This initiates the first printing operation, i,e., yellow image.

The controller 301 reads an yellow image for one line from the memory 303Y and sends it to the print controller 302. In response to the instruction from the controller 301, the print controller 302 translates the received data into another data format which can be handled by the thermal head 36, and sends the translated data to the thermal head 36. The thermal head 36 causes the heat generating elements to generate heat in accordance with the translated data so that the fused ink of the ink ribbon 31 for one line is transferred to the print-medium 26. The yellow image data is sent from the memory 303Y on a line-by-line basis so that the yellow ink is transferred to the print-medium 26 on a line-by-line basis until the yellow image data for one page has been printed on the print-medium 26. This completes the first printing operation, i,e., yellow image. The feeding motor 310 is halted so that the feeding rollers 24 and 25 are halted when the sensor 30 detects the trailing end of the print-medium 26, as depicted by waveforms D and E.

During the printing operation, the ribbon motor 311 continues to rotate to advance the ink film ribbon 311 from the supply reel 32 to the takeup reel 33 while at the same time the platen motor 13 and motor 19 causes the platen 10 and rings 14 and 15 to rotate in the directions shown by arrows A and B, respectively. Since the movable clamp member 21 is away from the platen 10, the print-medium 26 is not taut but has some stack 26*a* therein. The controller 301 causes the platen motor 13 to rotate so that the platen rotates in the direction shown by arrow A, while also causing the ring motor 19 to rotate so that the movable clamp member 21 rotates in the direction shown by arrow B. With the motors 13 and 19 rotating, the thermal head 36 causes the ink to be thermally transferred to the print-medium 26, performing the printing operation till the movable clamp member 21 arrives at a position just before the guides 28 and 29. When the movable clamp member 21 arrives at a point just before the guides 28 and 29, the motor 19 halts only the movable clamp member 21. During this period, the platen still rotates in the direction shown by arrow A performing the printing operation and producing the slack 26*a* in the print-medium 26 within a space 43. When the trailing end of the print-medium 26 reaches the area T in which the thermal head 36 contacts the platen 10, the up/down mechanism moves the thermal head 36 in the direction shown by arrow D so that the thermal head 36 is away from the platen 10, completing the first printing operation.

As described above, the print-medium 26 is advanced at a constant speed by the platen 10, being free from drift in speed. It is to be noted that the movable clamp member 21 travels around the platen 10 a distance less than the length of the print-medium 26.

Then, the motor 19 is rotated, causing the movable clamp member 21 to restart rotating in the direction shown by arrow B and the up/down mechanism moves the thermal head 36 in the direction shown by arrow E when the movable clamp member 21 passes through the gap between the thermal head 36 and the platen 10. The thermal head 36 is moved to the dotted line position in FIG. 1 and the heat generating elements of the thermal bead 36 are pressed to the platen 10 with the ink film ribbon 31 sandwiched therebetween. The ink film ribbon 31 is supplied from the supply reel 32 to the takeup reel 33 for the second printing operation (magenta image). The second and third printing operations are essentially the same as the first printing operation and therefore the description thereof is omitted.

Finally, the printing operation of a black image is performed. When the movable clamp member 21 travels past the gap between the thermal head 36 and platen 10, the up/down mechanism moves the thermal head 36 is in the direction shown by arrow E to the dotted line position in FIG. 1 so that the heat generating elements of the thermal head 36 is in pressure contact with the platen 10 with the ink film ribbon and the print-medium 26 sandwiched between the thermal head 36 and platen 10. The platen 10 is rotated in the direction shown by arrow A while at the same time the ink film ribbon 31 is fed from the supply reel 32 to the takeup reel 33, thereby starting the fourth printing operation (black image).

When the movable clamp member 21 arrives at a position immediately under the clamp driving mechanism 23, the controller 301 causes the motor driver 305 to stop the ring motor 19, thereby stopping the rings 14 and 15, i.e., the movable clamp member 21 is stopped. Then, the controller 301 causes the magnet driver 307 to activate the clamp driving mechanism 23, thereby releasing the movable clamp member 21 from the fixed clamp member 16 to create a gap between the movable clamp member 21 and the fixed clamp member 16. Thus, clamping is disabled.

Then, the controller 301 causes the motor driver 305 to drive the platen motor 13 and ribbon motor 311, thereby continuing the fourth printing operation. The discharge motor 313 is driven in rotation at the same time as the motors 13 and 311 run.

The discharge rollers 38 and 39 rotate in the directions shown in FIG. 7, so that the print-medium 26 guided by the guides 40 and 41 is pulled in between the rollers 38 and 39 and is discharged through the print-medium exit 42. The platen motor 13 and ribbon motor 311 run till the fourth printing operation completes. However, the clamp driving mechanism 23 remains activated and the discharge motor 313 remains rotated till the print-medium 26 is completely discharged. When the print-medium 26 has been completely discharged through the print-medium exit 42, the clamp driving mechanism 23 is deactivated and the discharge motor 313 is stopped, completing all the printing operations.

When the final page is being printed, the ring motor 19 is not rotated, that is, the movable clamp member 21 is at rest directly under the clamp driving mechanism 23.

The home sensor 20 detects the home mark located on the side surface of the ring 15 so that the movable clamp member 21 can be accurately positioned at its home position. This allows accurate positioning of the print-medium 26 with respect to the movable clamp member 21, and printing starts using the home position as a reference position so that the images of the respective colors can be accurately registered on the print-medium 26.

The aforementioned first embodiment yields the following advantages.

The movable clamp member 21 and the fixed clamp member 16 hold the leading end of the print-medium 26 by clamping, travel around the platen 10 a distance shorter than the length of the print-medium 26, and is halted in the middle of the printing operation, thereby allowing a slack in the print-medium 26 which is still being printed. This construction permits stable transporting of the print-medium 26 and prevents variations of distances between printed lines and is advantageous to miniaturizing the apparatus. The movable clamp member 21 and fixed clamp member 16 can be accurately positioned prior to the printing cycle of each color, preventing registration problem of the respective colors. Transporting the print-medium 26 only in the same direction for printing different colors in register eliminates the need to the transport the print-medium 26 back and forth with respect to printhead as is the case with the prior art apparatus, thereby increasing the printing speed.

If the print-medium is short in length, the printing operation can be performed by advancing the print-medium over a distance equal to the length of the print-medium. This further increases the printing speed.

Second Embodiment

<Construction>

Figure 8:
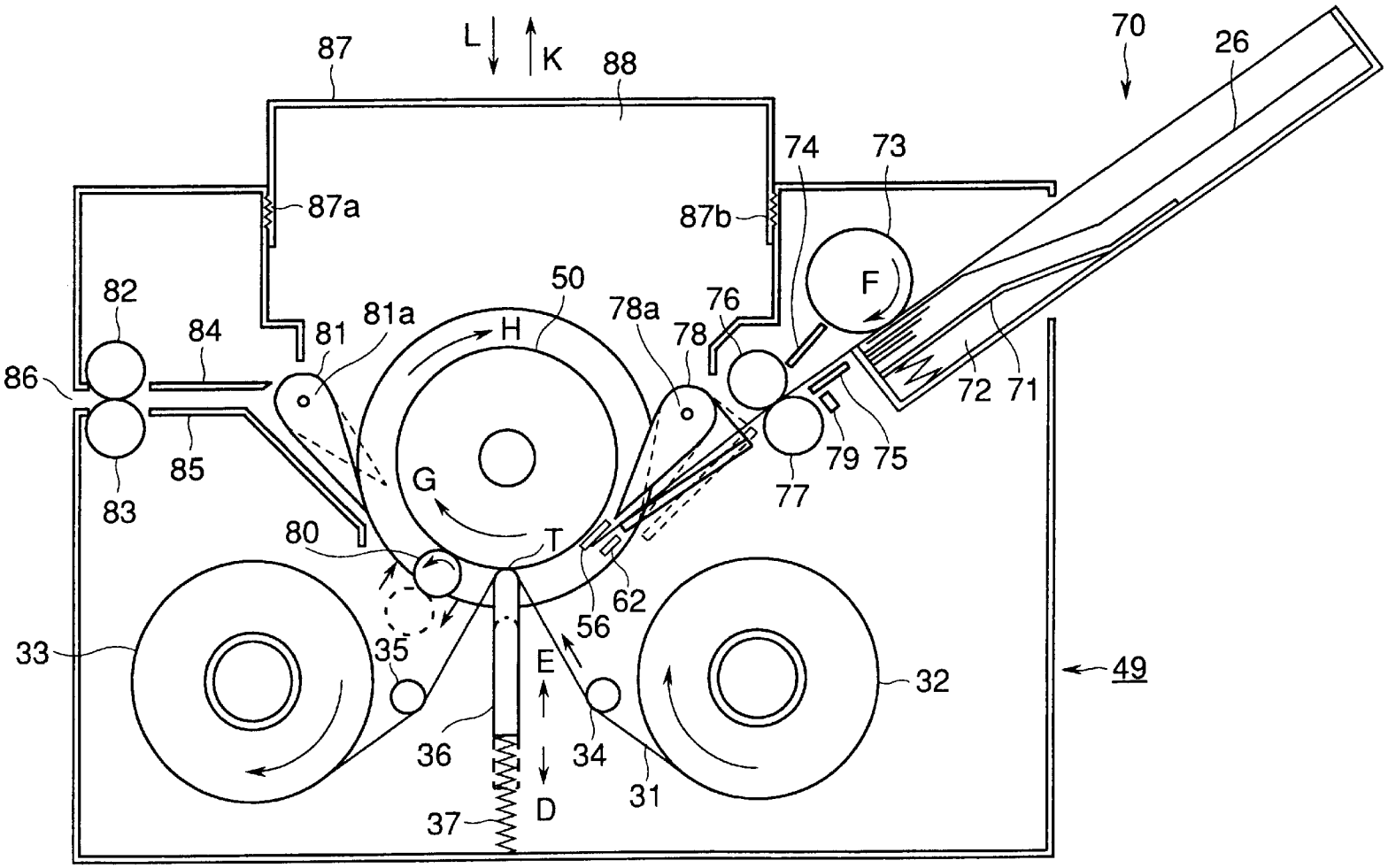
FIG. 8 is a side view of a second embodiment of a color image forming apparatus of the invention.

FIG. 8 is a side view of a second embodiment of a color image forming apparatus of the invention.

Figure 9:
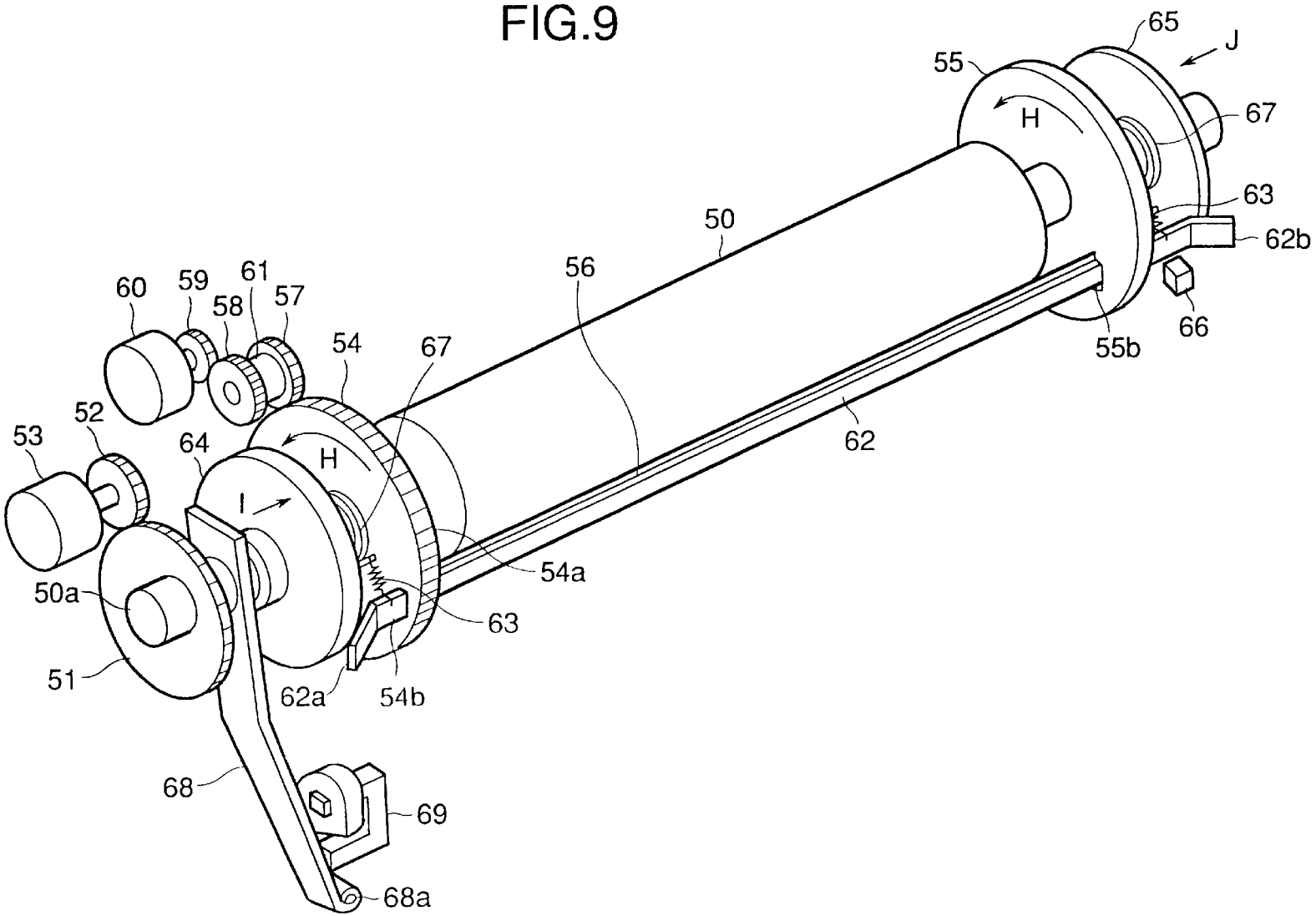
FIG. 9 is a perspective view of a relevant portion of the second embodiment.

FIG. 9 is a perspective view of a relevant portion of the second embodiment.

Referring to FIGS. 8 and 9, a color image forming apparatus 49 includes a platen 50 rotatably mounted therein. The platen 50 rotates on a shaft 50*a* to which a platen gear 51 is mounted. The platen gear 51 is in mesh with a motor gear 52 which in turn is secured to a shaft of a platen motor 53. When the platen motor 53 runs, the platen 50 rotates in a direction shown by arrow G in FIG. 8.

Discs 54 and 55 are mounted and rotate on the shaft 50*a* of the platen 50. Gear teeth 54*a* are cut on the outer circumference of the disc 54. The discs 54 and 55 are formed with guide holes 54*b* and 55*b* therein and a fixed clamp member 56 extends between the discs 54 and 55. The fixed clamp member 56 is fixedly mounted to the discs 54 and 55.

The gear teeth 54*a* are in mesh with an idle gear 57. The idle gear 57 is assembled to another idle gear 58 via a torque limiter 61. Thus, idle gears 57 and 58 rotate on the same rotational axis. The idle gear 58 is in mesh with a motor gear 59 which is secured to the shaft of a motor 60. When the motor 60 runs, its rotation is transmitted through the gears 59, 58, 57 to the discs 54 and 55 so that the fixed clamp member 56 rotates in the direction shown by arrow H. The drive torque is transmitted from the motor 60 via the motor gear 59 to the idle gear 58, while the load torque is transmitted from the discs 54 and 55 via the gear teeth 54*a* to the idle gear 57. The torque limiter 61 slips when a difference between the drive torque and the load torque becomes greater than a predetermined value.

A movable clamp member 62 is located to oppose the fixed clamp member 56. The movable clamp member 62 also extends through the guide holes 54*b* and 55*b* and is movable in the guide holes to and from the movable clamp member 62. The fixed clamp member 56 is urged by springs 63 against the fixed clamp member 56 and is normally in contact with the fixed clamp member 56. Clamp driving plates 64 and 65 are disposed adjacent discs 54 and 55 with the discs 54 and 55 between the clamp driving plates 64 and 65. The clamp driving plates 64 and 65 are movable toward and away from the discs 54 and 55. A compression spring 67 is mounted between the disc 54 and clamp driving plate 64 and another compression spring 67 is mounted between the disc 55 and clamp driving plate 65. An actuator 68 is pivotal about a pin 68*a* and the free end portion of the actuator 68 is formed with a hole therein through which the shaft 50*a* of the platen 50 loosely extends. An electromagnet 69 is disposed to oppose the actuator 68 and attracts the actuator 68 when the electromagnet 69 is energized, causing the actuator 68 to push the clamp driving plate 64 against the spring force of the spring 67 toward the disc 54 in a direction shown by arrow I. Another actuator 68 and electromagnet 69, not shown, are provided adjacent the clamp driving plate 65 so as to push the clamp driving plate 65 in a direction shown by arrow J.

When the electromagnets 69 are energized, the clamp driving plates 64 and 65 slide in the directions shown by arrows I and J, respectively. The outer circumferences of the clamp driving plates 64 and 65 engage end portions 62*a* and 62*b* of the movable clamp member 62 to move the movable clamp member 62 out of the way so that the movable clamp member 62 moves out of contact engagement with the fixed clamp member 56 creating a gap therebetween.

When the electromagnets 69 are deenergized, the compression springs 67 cause the clamp driving member 64 and 65 to slide in directions opposite to arrows I and J, respectively. Due to the urging forces of the springs 63, the movable clamp member 62 moves toward the fixed clamp member 56 closing the gap therebetween.

A home sensor 66 shown in FIG. 9 is a reflection type photosensor and detects the movable clamp member 62, thereby detecting that the fixed clamp member 56 is at its home position.

Referring to FIG. 8, the paper cassette 70 accommodates the print-medium 26 on a platform 71 urged upward by a spring 72. A paper pick-up roller 73 is over the paper cassette 70 and rotates in a direction shown by arrow F in FIG. 8 to feed the top one page of the print-medium 26 from the paper cassette 70 into the guides 74 and 75. The guides 74 and 75 directs the print-medium 26 to a pair of feeding rollers 76 and 77. A guide flap 78 is pivotal about a pin 78*a* and switched between a dotted line position and a solid line position. When positioned at the solid line position in FIG. 8, the guide flap 78 directs the print-medium 26 into a gap between the movable clamp member 62 and fixed clamp member 56. A sensor 79 is, for example, a reflection type photosensor and detects the leading end and trailing end of the print-medium 26 when the print-medium 26 passes over the sensor 79.

Disposed at the lower part of the image forming apparatus 49 are an ink film supply reel 32 and an ink film takeup reel 33 under the path of the print-medium 26 and an ink film ribbon 31 rides on the reels 32 and 33. The ink film ribbon 31 is the same as that used in the first embodiment. Guide rollers 35 and 34 are freely rotatable and guide the ink ribbon 31 between the reels 32 and 33. A thermal head 36 is the same as that in the first embodiment. The thermal head 36 is urged by a spring 37 into pressure contact with the platen 50 at an area T and moved by an up/down mechanism, not shown, in the direction shown by arrow D away from the platen 50.

A pinch roller 80 is movable between a solid line position where the pinch roller 80 moves into abutment engagement with the platen 50 and a dotted line position where the pinch roller 80 moves out of abutment engagement with the platen 50. A guide flap 81 is pivotal about 81*a* between a solid line position and a dotted line position. Discharge rollers 82 and 83 rotate to discharge the print-medium 26, directed by the guide flap 81 and guided between guides 84 and 85, to the print medium exit 86.

A paper guide 87 is made of a clear plastics and may be moved in directions shown by arrows K and L. Fasteners 87*a* and 87*b* are formed in the guide 87 and chassis of the image forming apparatus 49, respectively, so that the paper guide 87 may be positioned at a desired position. The paper guide 87 is clear and therefore the print-medium 26 in a space 88 can be viewed from outside.

<Operation>

Figure 10:
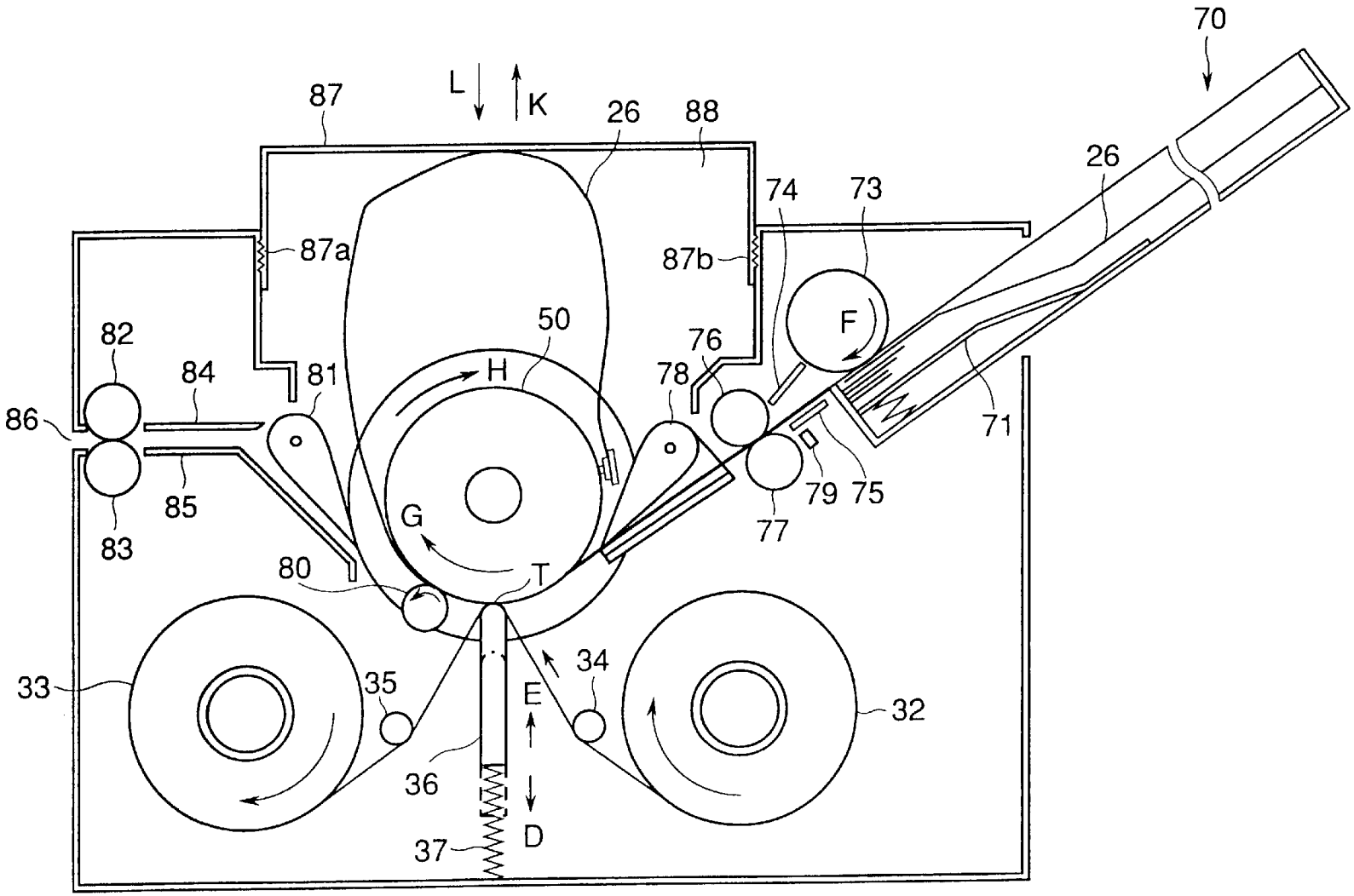
FIGS. 10 and 11 are side views showing the operation of the second embodiment.
Figure 11:
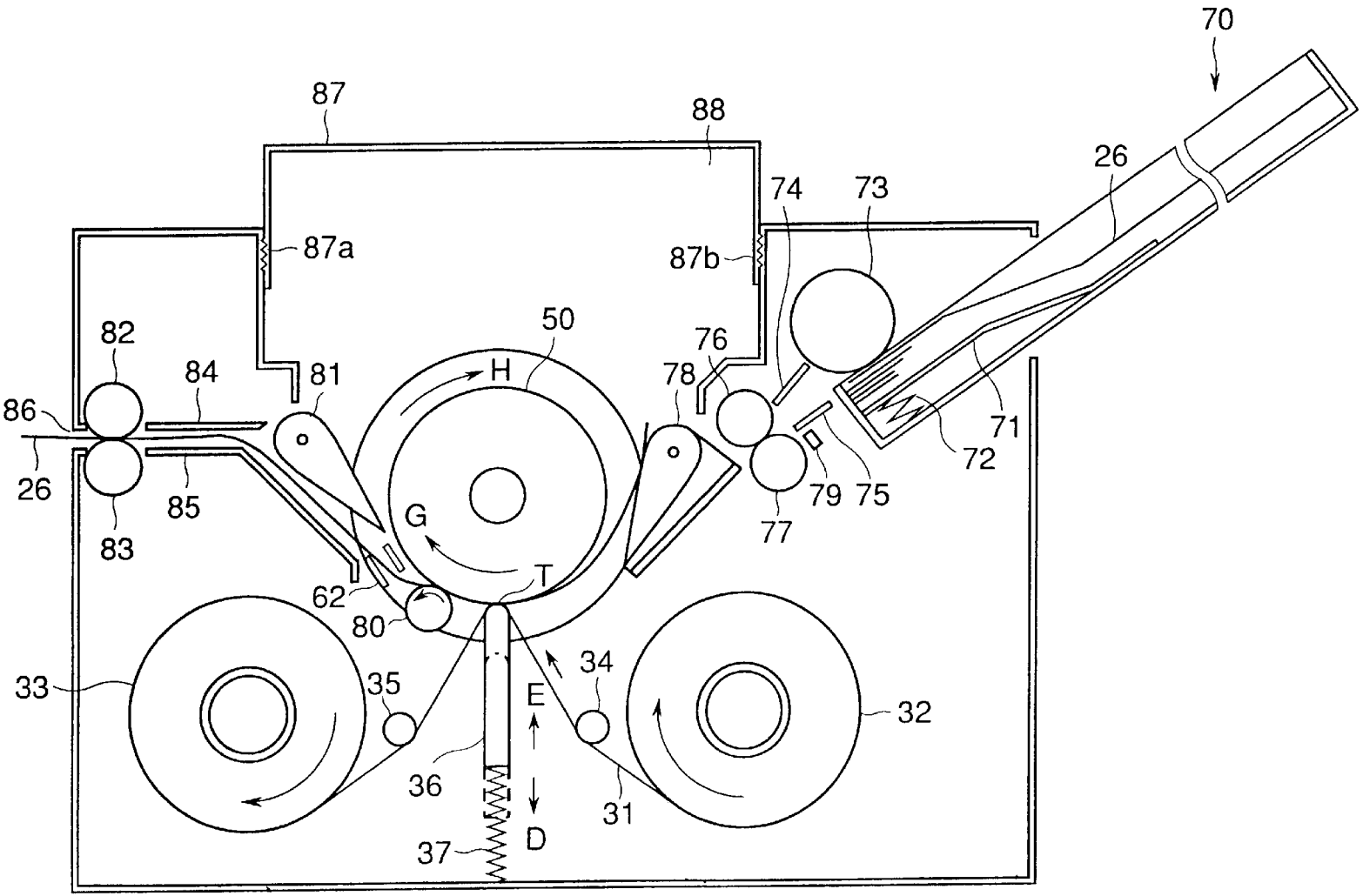

FIGS. 10 and 11 are side views showing the operation of the second embodiment. The second embodiment will be further described with reference to FIGS. 10 and 11.

The motor 53 run to rotate the discs 54 and 55 together with the fixed clamp member 56 and movable clamp member 62 in the direction shown by arrow H. The motor 53 is halted when the home sensor 66 detects that the movable clamp member 62 is at its home position. This home position is a position where the movable clamp member 62 is in FIG. 8. With the movable clamp member 62 at its home position, the electromagnets 69 (FIG. 9) are energized so that the clamp driving plates 64 and 65 slide in the directions shown by arrows I and J, respectively. The clamp driving plates 64 and 65 release the movable clamp member 62 from the fixed clamp member 56 to create a gap therebetween. Then, the guide flaps 78 and 81 are positioned at their solid line positions and the paper pick-tip roller 73 is rotated in the direction shown by arrow F shown in FIG. 8 to advance the top page of print-medium 26 in the paper cassette 70. The print-medium 26 is directed to a pair of feeding rollers 76 and 77 and the leading end of the print-medium 26 is detected by the sensor 79. After the detection of the leading end of the print-meditim 26, the print-medium 26 is further advanced a predetermined distance so that the leading end of the print-medium 26 enters the gap between the fixed clamp member 56 and the movable clamp member 62. Then, the rotation of the paper pick-up roller 73 and feeding rollers 76 and 77 are temporarily halted.

When the electromagnets 69 are deenergized, the compression springs 67 cause the clamp driving plates 64 and 65 to slide in the directions opposite to arrows J and I, respectively, allowing the clamp driving plates 64 and 65 to move out of the contact engagement with the movable clamp member 62. Thus, the movable clamp member 62 is pressed against the fixed clamp member 56 with the aid of the urging force of the springs 63. Thus, the leading end of the print-medium 26 is clamped between the fixed clamp member 56 and the movable clamp member 62.

After clamping, an up/down mechanism, not shown, moves the thermal head 36 in the direction shown by arrow D to the dotted line position in FIG. 8, thereby moving the thermal head 36 out of contact engagement with the platen 50. The pinch roller 80 is also moved out of contact engagement with platen 50 to the dotted line position. Subsequently, the paper pick-up roller 73, and feeding rollers 76 and 77 are rotated. The platen motor 53 and motor 60 are also caused to run, driving the platen 50 to rotate in the direction shown by arrow G and the discs 54 and 55 in the direction shown by arrow H.

Thus, the movable clamp member 62 starts moving. Shortly after the movable clamp member 62 passes the gap between the thermal head 36 and the platen 50, the up/down mechanism causes the thermal head 36 to move in the direction shown by arrow E to the solid line position in FIG. 8 so that the heat generating elements of the thermal head 36 are in pressure contact with the platen 50 with ink film ribbon 31 and the print-medium 26 therebetween. The fist printing operation (yellow image) starts, the ink film ribbon 31 being fed from the ink film supply reel 32 to the ink film takeup reel 33.

During the first printing operation, the paper pick-up roller 73 and the feeding rollers 76 and 77 are halted to rotate when the trailing end of the print-medium 26 has passed the feeding rollers 76 and 77. During the first printing operation, the ink film ribbon 31 is advanced from the ink film supply reel 32 to the ink film takeup reel 33, and the platen motor 53 and motor 60 are rotated, so that the platen 50 rotates in the directions shown by arrow G and discs 54 and 55 in the direction shown by arrow H. The discs 54 and 55 are rotated somewhat faster than the platen 50 so that the torque limiter 61 slips even when a load torque greater than a predetermined value is applied on the discs 54 and 55. This slippage of the torque limiter 61 ensures that a predetermined tension is always applied to the print-medium 26 between the platen 50 and the movable clamp member 62. When the movable clamp member 62 has advanced past the gap between the pinch roller 80 and the platen 50, the pinch roller 80 is moved to the solid line position in FIG. 8. Thus, the print-medium 26 is always given a tension, facilitating the peeling of the ink from the ink film ribbon 31 to the print-medium 26.

Ink is thermally transferred to the print-medium 26 while causing the platen 50 to rotate in the direction shown by arrow G and the movable clamp member 62 to rotate around the platen 50 in the direction shown by arrow H. When the movable clamp member 62 arrives at a position beside the guide flap 78 as shown in FIG. 10, the motor 60 is halted so that the movable clamp member 62 come to a halt during which the platen 50 is still rotated in the direction shown by arrow G to carry out the printing operation and the printed print-medium 26 has a flexible slack therein. The amount of slack varies depending on the length of the print-medium 26. Thus, the guide 87 is slid in the directions shown by arrow K or L to adjust the space 88.

When the trailing end of the print-medium 26 has reached the area T at which the thermal head 36 contacts the platen 50, the guide flap 78 is rotated to the dotted line position shown in FIG. 8 and the up/down mechanism moves the thermal head 36 in the direction shown by arrow D away from the platen 50. When the trailing end of the print-medium 26 has passed the contact point between the pinch roller 80 and platen 50, the pinch roller 80 is moved to the dotted position. This completes the first printing operation (yellow).

As described above, the platen 50 allows the print-medium 26 to travel at a constant speed when printing operation is performed, so that the speed of the print-medium 26 will not drift. The total distance that the movable clamp member 62 travels around the platen 50 is less than the length of the print-medium 26.

Then, the controller causes the motor 60 to run, thereby driving the discs 54 and 55 in rotation, and when the movable clamp member 62 has passed the gap between the thermal head 36 and the platen 50, the up/down mechanism moves the thermal head 36 in the direction shown by arrow E to the solid line position in FIG. 8 where the heat generating elements of the thermal head 36 presses the platen 50 at the area T with the ink film ribbon 31 and the print-medium 26 sandwiched between the thermal head 36 and the platen 50. Then, ink film ribbon 31 is fed from the ink film supply reel 32 to the ink film takeup reel 33, thereby starting the second printing operation (magenta image). The second and third printing operations are the same as the first printing operation and the description thereof is omitted.

Finally, the fourth printing operation (black image) is performed. When the movable clamp member 62 has passed the gap between the thermal head 36 and the platen 50, the up/down mechanism moves the thermal head 36 in the direction shown by arrow E to the solid line position to start the fourth printing operation, i.e., black image. When the movable clamp member 62 has passed the gap between the pinch roller 80 and the platen 50, the pinch roller 80 is moved to the solid line position shown in FIG. 8. When the movable clamp member 62 has passed the pinch roller 80 to a position shown in FIG. 11, the motor 60 is stopped so that the discs 54 and 55 are stopped, i.e., movable clamp member 62. Then, the clamp driving plates 64 and 65 are caused to slide in the directions shown by arrows I and J, respectively, to raise the movable clamp member 62 from the fixed clamp member 56, thereby creating a gap between the movable clamp member 62 and the fixed clamp member 56. At the same time, the guide flap 81 is switched to the position shown in FIG. 11. Then, the printing operation is still continued so that the leading end of the print-medium 26 leaves the movable clamp member 62 as shown in FIG. 11 and is guided by the guide flap 81 and the guides 84 and 85 to the discharge rollers 82 and 83.

In this manner, the print-medium 26 is transported by the discharge rollers 82 and 83 through the print-medium exit 86 while still performing the fourth printing operation. The fourth printing is carried out till the entire black image has been printed. Then, the entire printing operation completes when the print-medium 26 has been discharged completely.

When the length of the print-medium 26 is relatively short, the time required for the printing operation is short accordingly, implementing as short a printing time as possible.

In the second embodiment, printing operation starts from a position a predetermined distance from the home position where the home mark on the movable clamp member 62 is detected by the home mark sensor 66. Thus, the movable clamp member 62 and fixed clamp member 56 can always be positioned at the same home position with the aid of the home mark. Therefore, there is no registration problem of the images of the respective colors.

An ink film ribbon of only black ink may be used when performing monochrome printing.

The second embodiment offers the following advantages. The movable clamp member 62 travels in a circular path concentric with the platen 50 as opposed to the first embodiment. This is advantageous in miniaturizing the image forming apparatus. The torque limiter 61 and pinch roller 80 are used to apply a tension to the print-medium 26 at all times during printing operation. This makes it possible for the ink to come off the ink film ribbon 31, reducing drift in speed and registration problem.

The guide 87 is transparent so that the operator can visually monitor the printing operation in the middle of the printing operation. The position of the guide 87 is adjustable with respect to the body in accordance with the length the print-medium 26. In other words, the image forming apparatus may be reduced in size when not in use.

Third Embodiment

<Construction>

Figure 12:
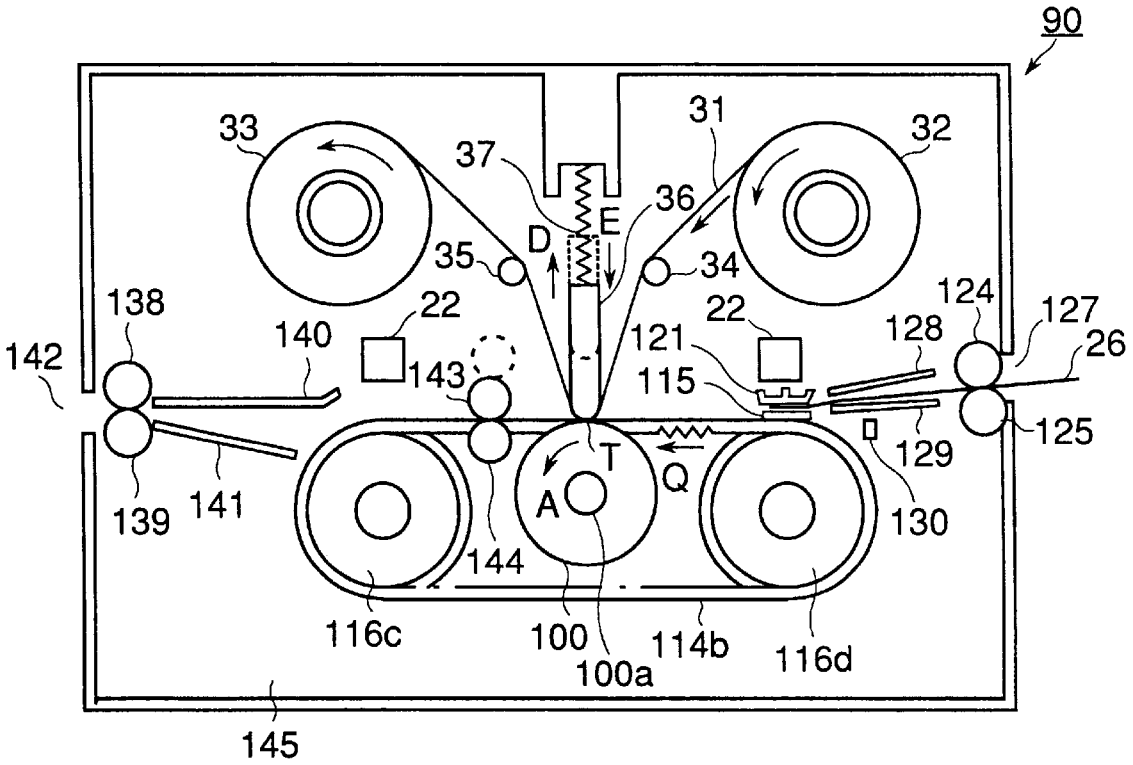
FIG. 12 is a side view of a color image forming apparatus according to the third embodiment.
Figure 13A:
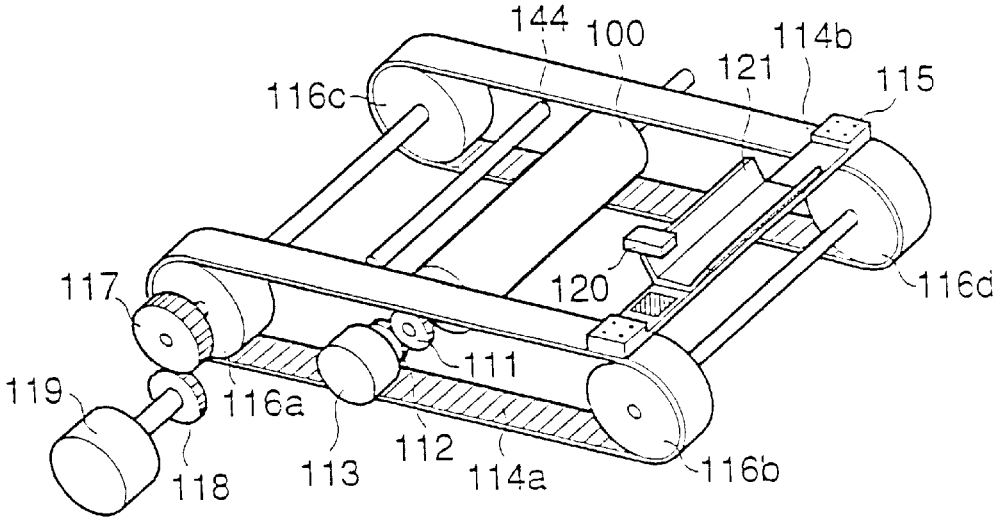
FIG. 13A is a perspective view illustrating a relevant portion of the third embodiment.
Figure 13B:
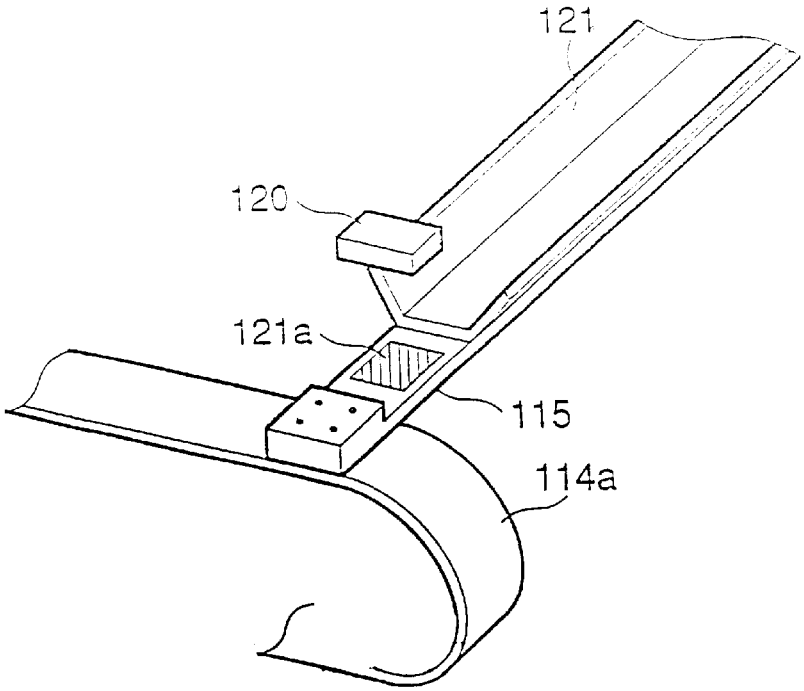
FIG. 13B is a fragmentary perspective view of a part of of FIG. 13A.

A third embodiment of the invention will be described with reference to FIGS. 12 and 13A–13B. FIG. 12 is a side view of a color image forming apparatus of the third embodiment. FIG. 13A is a perspective view illustrating a relevant portion of the third embodiment. FIG. 13B is a fragmentary perspective view of a part of FIG. 13A. In the third embodiment, the print-medium 26 is clamped to endless belts and travels around the platen together with the endless belts.

Referring to FIGS. 12 and 13A, a platen 100 is rotatably supported on a shaft 100*a* to which a platen gear 111 is secured. The platen gear 111 meshes with a motor gear 112. The motor gear 112 is fixedly mounted to a shaft of a platen motor 113. When the motor 113 rotates, the platen 100 is rotated in a direction shown by arrow A shown in FIG. 12.

A pair of timing belts 114*a* and 114*b* runs at the same peripheral speed in directions perpendicular to the length of the platen 100 near the longitudinal ends of the platen 100. A fixed clamp member 115 extends across the timing belts 114*a* and 114*b* and is fixedly mounted at both longitudinal ends thereof to the timing belts 114*a* and 114*b*. The timing belts 114*a* and 114*b* ride on pulleys 116*c* and 116*d* and 116*a* and 116*b*, respectively, in such a manner that the belts are held sufficiently taut. The pulley 116*a* has a shaft to which a gear 117 is fixedly mounted. The gear 117 meshes a motor gear 118 which is fixedly mounted to a shaft of a motor 119. Therefore, when the motor 119 runs, it drives the timing belts 114*a* and 114*b* and fixed clamp member 115 in rotation in a direction shown by arrow Q as shown in FIG. 12.

A home sensor 120 is, for example, a reflection type photosensor and disposed substantially over the fixed clamp member 115 as shown in FIG. 13B. The home sensor 120 detects a home mark 121*a* provided on the fixed clamp member 115, thereby detecting that the timing belts 114*a* and 114*b* are at their home position.

A movable clamp member 121 of substantially the same construction as that of the first embodiment is urged by a spring, not shown, to the fixed clamp member 115 so that the movable clamp member 121 is normally in contact with the fixed clamp member 115. Clamp driving mechanisms 22 and 23 are activated to move the movable clamp member 121 into contact engagement with the fixed clamp member 115 and deactivated to move the movable clamp member 121 out of contact engagement with the fixed clamp member 115. When the fixed clamp member 115 and movable clamp member 121 have arrived at a position immediately under the clamp driving mechanism 22 or 23, an electromagnet of the clamp driving mechanism 22 or 23 is energized, so that the camp member 121 moves out of contact engagement with the fixed clamp member 115 to create a gap between the movable clamp member 121 and the fixed clamp member 115. When the electromagnet of the clamp driving mechanism 22 or 23 is deenergized, the movable clamp member 121 moves into contact engagement with the fixed clamp member 115 since the movable clamp member 121 is urged by a spring toward the fixed clamp member 115.

Feeding rollers 124 and 125 advance the print-medium 26 through a print-medium entrance 127 into the apparatus 90. The print-medium 26 is guided by guides 128 and 129 into a gap between the movable clamp member 121 and fixed clamp member 115. The sensor 130 is, for example, a reflection type photosensor and detects the leading end and trailing end of the print-medium 26 fed through the print-medium entrance 127 into the apparatus 90.

Ink film ribbon 31, ink film supply reel 32, ink film takeup reel 33, and thermal head 36 are the same as those in the first embodiment.

Pinch rollers 143 and 144 hold the print-medium 26 between the pinch rollers and the platen 100. The pinch roller 143 is adapted to be switched between the solid line position and the dotted line position in FIG. 12. Discharge rollers 138 and 139 receive the printed print-medium 26 transported by the guides 140 and 141 and discharge the print-medium 26 through a print-medium exit 142.

<Operation>

The operation of the third embodiment will be described.

The motor 119 runs to drive the timing belts 114*a* and 114*b* and fixed clamp member 115 and movable clamp member 121 in a direction shown by arrow Q, and stops when the home sensor 120 detects the home mark 121*a* on the fixed clamp member 115. The home position of the movable clamp member 121 is a position where the fixed clamp member 115 and movable clamp member 121 are immediately under the clamp driving mechanism 22. With the movable clamp member 121 is at the home position, the clamp driving mechanism 22 is activated to move the movable clamp member 121 out of contact engagement with the fixed clamp member 115, creating a gap between the fixed clamp member 115 and movable clamp member 121.

Upon inserting the print-medium 26 through the print-medium entrance 127, the feeding rollers 124 and 125 rotate to pull the print-medium 26 in between the guides 128 and 129 where the sensor 130 detects the leading end of the print-medium 26. With respect to the detection of the leading end of the print-medium 26, the print-medium 26 is advanced a predetermined distance. When the leading end of the print-medium 26 enters the gap between the fixed clamp member 115 and movable clamp member 121, the feeding rollers 324 and 125 are halted. Then, the clamp driving mechanism 22 is deactivated to close the gap between the movable clamp member 121 and fixed clamp member 115, thereby clamping the leading end of the print-medium 26. After clamping, the pinch roller 143 is moved to the dotted line position in FIG. 12 and the up/down mechanism, not shown, causes the thermal head 36 to move in the direction shown by arrow D to the dotted line position in FIG. 12, thereby moving the thermal head 36 out of contact engagement with the platen 100. Subsequently, the feeding rollers 124 and 125 are rotated again, and platen motor 113 is rotated to drive the platen 100 in the direction shown by arrow A and motor 119 is rotated to drive the timing belts 114*a* and 114*b* to rotate in the direction shown by arrow Q.

When the movable clamp member 121 has passed the gap between the thermal head 36 and the platen 100, the up/down mechanism causes the thermal head 36 to move in the direction shown by arrow E to the solid line position in FIG. 12, so that the heat generating elements of the thermal head 36 are in pressure contact with the platen 100 at an area T with the ink film ribbon 31 and the print-medium 26 sandwiched between the thermal head 36 and the platen 100. Then, the ink film ribbon 31 is fed from the ink film supply reel 32 to the ink film takeup reel 33, starting the first printing operation (yellow image).

When the sensor 130 detects the trailing end of the print-medium 26, the feeding rollers 124 and 125 are stopped. During the printing operation, the ink film ribbon 31 is fed from the ink film supply reel 32 to the ink film takeup reel 33 while at the same time the platen motor 113 and the motor 119 are rotated to drive the platen 100 and the timing belts 114*a* and 114*b* in rotation, respectively, in such a way that the platen 100 and the timing belts run at the same peripheral speed in the directions shown by arrows A and Q, respectively. When the movable clamp member 121 has passed between the pinch rollers 143 and 144, the pinch roller 143 is returned to the solid line position in FIG. 12, thereby applying a tension force to the print-medium 26 so that the ink easily come off the ink film ribbon 31 and is deposited to the print-medium 26.

Then, the printing operation continues, i.e., the platen 100 is further rotated in the direction shown by arrow A, the movable clamp member 121 travels around the platen 100 in the direction shown by arrow Q, and the thermal head 36 causes the ink to be thermally transferred to the print-medium 26. When the movable clamp member 121 has arrived at the pulleys 116*b* and 116*d*, the motor 119 is stopped so that only the movable clamp member 121 is stopped. The printing operation is still continued with the platen 100 rotating in the direction shown by arrow A and therefore the print-medium 26 having ink transferred thereon will have a slack therein within the space 145. When the trailing end of the recording member 26 arrives at the area T where the thermal head 36 contacts the platen 100, the up/down mechanism causes the thermal head 36 to move in the direction shown by arrow D so that the thermal head 36 is out of contact engagement with the platen 100. When the trailing end of the print-medium 26 has passed the contact; point between the pinch rollers 143 and 144, the pinch roller 143 is moved to the dotted line position. This complete the first printing operation.

Then, the motor 119 is rotated to cause the movable clamp member 121 to travel around the platen 100. When the movable clamp member 121 has passed the gap between the thermal head 36 and the platen 100, the up/down mechanism causes the thermal head 36 to move in the direction shown by arrow E to the solid line position in FIG. 12, so that the heat generating elements of the thermal head 36 are in pressure contact with the platen 100 with the ink film ribbon 31 and the print-medium 26 sandwiched between the thermal head 36 and the platen 100. The ink film ribbon 31 is fed from the ink film supply reel 32 to the ink film takeup reel 33, starting the second printing operation. The second and third printing operations are the same as the first printing operation and the description thereof is omitted.

Finally, the fourth printing operation is performed. When the movable clamp member 121 has passed a gap between the thermal head 36 and the platen 100, the up/down mechanism causes the thermal head 36 to move in the direction shown by arrow E to the solid line position in FIG. 12 so that the heat generating elements of the thermal head 36 are in pressure contact with the platen with the ink film ribbon 31 and the print-medium 26 sandwiched between the thermal head 36 and the platen 100. In this manner, the fourth printing operation starts.

When the movable clamp member 121 has passed between the pinch rollers 143 and 144, the pinch roller 143 is lowered to the solid line position in FIG. 12 for printing operation. The movable clamp member 121 travels around the platen 100 during the fourth printing operation and when the movable clamp member 121 arrives again at a position immediately under the clamp driving mechanism 23, the motor 119 is halted to halt the timing belts 114*a* and 114*b*, i.e., the movable clamp member 121.

Then, the clamp driving mechanism 23 is activated to cause the movable clamp member 121 to move out of the contact engagement with the fixed clamp member 115, creating a gap between the fixed clamp member 115 and the movable clamp member 121. I this manner, clamping is disabled. With the clamping disabled, the printing operation is further carried out so that the leading end of the print-medium 26 is released from the movable clamp member 121 and fixed clamp member 115 and guided between the guides 140 and 141 to the discharge rollers 138 and 139. In this manner, the print-medium 26 is discharged while the part of the print-medium 26 is still being subjected to the fourth printing operation. The fourth printing operation is carried out tilt the image of the fourth color has been completely printed. The print-medium 26 is then transported by the discharge rollers 138 and 139 through the print-medium exit 142. This completes the fourth printing operation.

The ink film ribbon may have only black ink if the image forming apparatus is to perform only monochrome printing.

As described above, the print-medium 26 is advanced at a constant speed by the platen 100, being free from drifts in speed. It is to be noted that the movable clamp member 121 travels around the platen 100 a distance less than the length of the print-medium 26.

The third embodiment offers the same advantages as the first and second embodiment. The third embodiment also provides the following advantages.

The movable clamp member 121 travels around the platen 100 while being carried on the timing belts 114*a* and 114*b*. This arrangement is effective in implementing a thin construction of the image forming apparatus. The third embodiment requires no such guide means as guide flaps 78 and 81 used in the second embodiment, and therefore the overall construction is simple and inexpensive.

While the third embodiment has been described with respect to a pair of timing belts, an endless type transport belt may be used in place of the pair of timing belts. The movable clamp member 121 may be secured to the endless transport belt so that the movable clamp member travels around the platen.

The movable paper guide 87 used in the second embodiment may also be used in the first and third embodiment.

Fourth Embodiment

The first to third embodiments are for recording images using an ink film ribbon having yellow ink, magenta ink, cyan ink, and black ink. If monochrome printing is performed using only black ink, then yellow ink, magenta ink, and cyan ink are wasted. In fact, monochrome printing using only black ink is often performed and the waste of ink film ribbon has been a problem. A fourth embodiment is to solve this problem.

<Construction>

The fourth embodiment will be described with reference to FIGS. 14–16.

Figure 14:
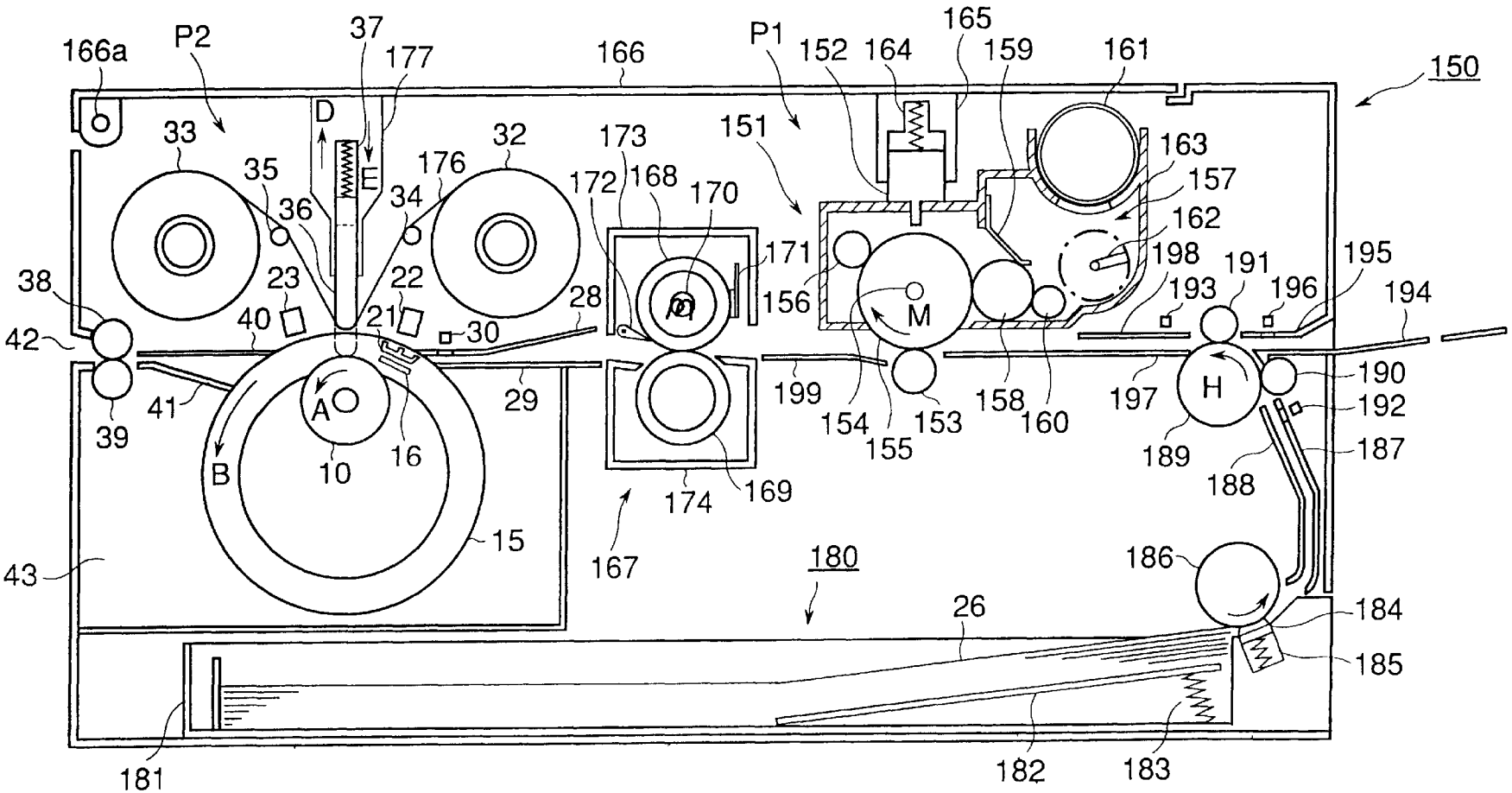
FIG. 14 is a side view illustrating a color image forming apparatus according to the fourth embodiment.

FIG. 14 is a side view illustrating a color image forming apparatus according to the fourth embodiment.

Figure 15:
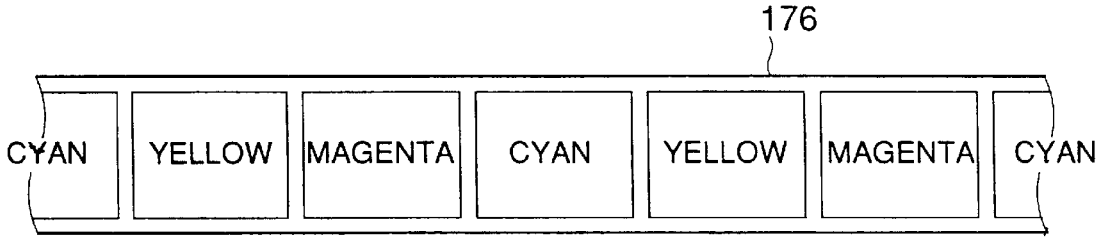
FIG. 15 illustrates an ink film ribbon of the fourth embodiment.

FIG. 15 illustrates an ink film ribbon of the fourth embodiment.

Figure 16:
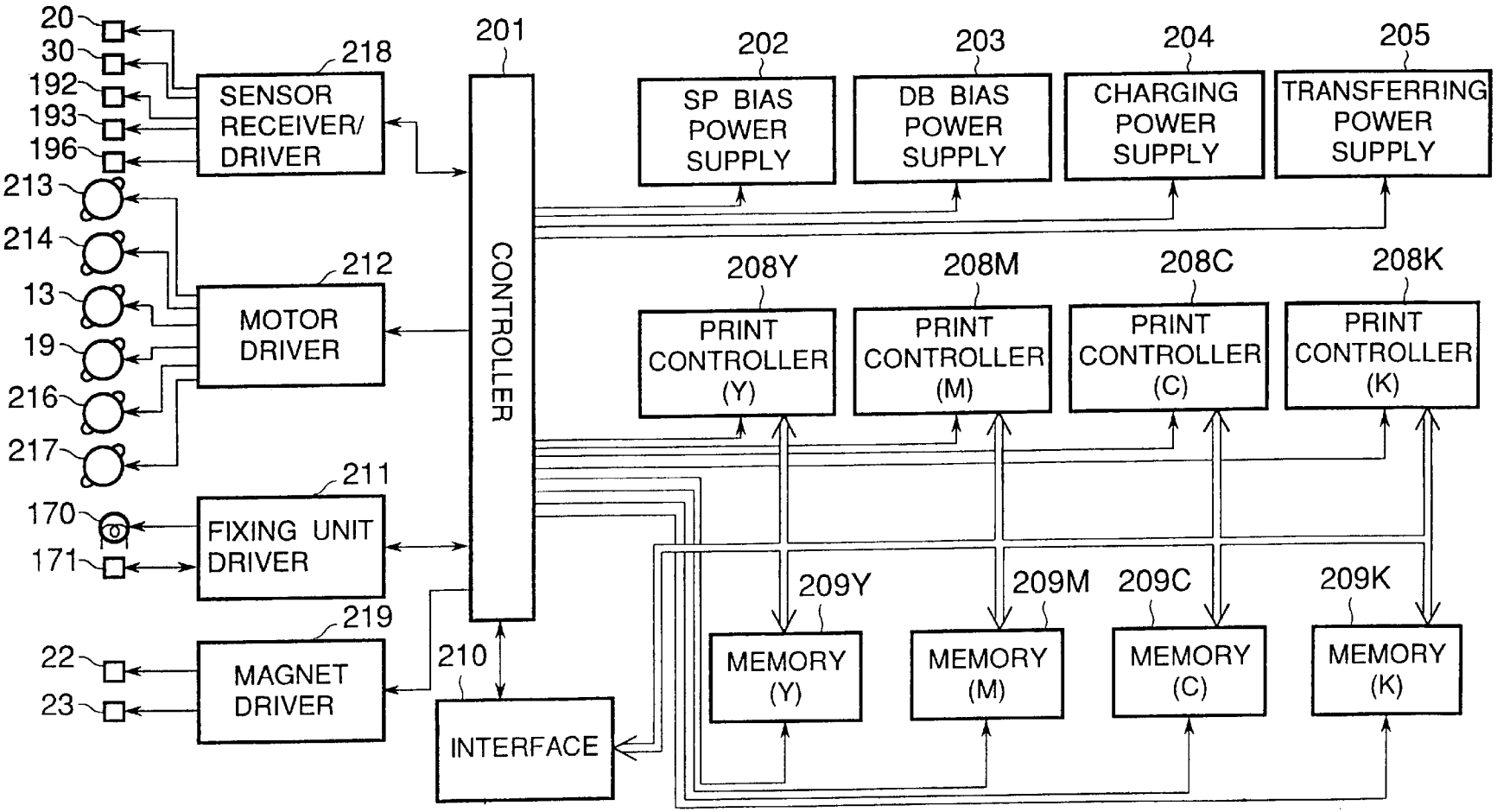
FIG. 16 is a block diagram illustrating the control system of the fourth embodiment.

FIG. 16 is a block diagram illustrating the control system of the fourth embodiment.

Referring to FIG. 14, there are provided first and second printing mechanisms P1 and P2, aligned in order along the transport path of the print-medium 26 in a color image forming apparatus 150. The first printing mechanism P1 is an LED type electrophotographic printer which performs printing operation using only black toner. The first printing mechanism P1 includes a black image forming section 151, an LED head 152 which illuminates the photosensitive drum 155 in accordance with image data, and a transfer roller 153 which transfers a toner image formed on the photosensitive drum 155. The image forming section 151 includes the photosensitive drum 155 and a charging roller 156, and a developing unit 157. The photosensitive drum 155 rotates on a shaft 154 in a direction shown by arrow M. The charging roller 156 causes the surface of the photosensitive drum 155 to be uniformly charged. The developing unit 157 includes a developing roller 158, developing blade 159, sponge roller 160, toner tank 161, and agitator 162. The structural components of the image forming section 151 are supported by a frame 163. When the toner tank 161 runs out of toner, the toner tank 161 can be replaced by a new, unused tank.

The LED head 152 includes an LED array, printed circuit board on which driver ICs for driving the LED array are mounted, and Selfoc lens array for focusing light emitted from the LED array. The LED array are energized in accordance with the image data received via a later described interface. Then, the light emitted from the LED illuminates the surface of the photosensitive drum 155 to form an electrostatic latent image on the surface. Then, the developing roller 158 applies toner to the electrostatic latent image to develop the electrostatic latent image. The LED head 152 is urged by a spring 164 downward in FIG. 14. The LED head 152 and spring 164 are supported by a supporting member 165 which is secured to an upper cover 166. The developing unit 157 holds black toner therein and the LED head 152 receives a black image signal of color image signals.

A fixing station 167 is located downstream of the photosensitive drum 155. The fixing station 167 fixes the toner image transferred onto the print-medium 26. The fixing station 167 includes a heat roller 168, pressure roller 169, heater 170, thermistor 171, separator 172, upper and lower cases 173 and 174. The heat roller 168 heats the toner on the print-medium 26. The pressure roller 169 presses the print-medium 26 against the heat roller 168. The heater 170 is disposed in the heat roller 168 and generates heat. The thermistor 171 is in contact with the outer surface of the heat roller 168 to detect the temperature of the outer surface.

The heat roller 168 and pressure roller 169 are rotatably supported and driven in rotation by drive means, not shown. The heat roller 168 is a hollow cylindrical core of, for example, aluminum which is covered with a thin layer of mold release such as PFA (Perfluoroalcoxy) or ETFE (Ethylene-Tetrafluoroethylene). Disposed inside of the heat roller 168 is a heater 170 such as halogen lamp. The pressure roller 169 is a hollow cylindrical core of, for example, aluminum which is covered with a 1–2 mm thick layer of a refractory resilient material. The pressure roller 169 is further covered with a 3–100 micron thick layer of a mold release. The layer of a refractory resilient material is made relatively thick and heat roller 168 is made hard so that a nip is formed between the heat roller 168 and pressure roller 169.

A thermistor 171 is in contact with the outer surface of the heat roller 168 to detect the surface temperature. The energization of the heater 170 is controlled by known temperature control means, not shown, on the basis of the detected temperature so as to maintain a constant surface temperature of the heat roller 168.

A plurality of flaps 172 are disposed on the discharge side of the heat roller 168 and aligned along the length of the heat roller 168. The free ends of the flaps 172 are in contact with the surface of the heat roller 168 and serve to separate the print-medium 26 from the heat roller 168.

The first printing mechanism P1 is of an electrophotography type and the toner image is subjected to heat when fixing. In contrast, a second printing mechanism P2 is of a thermal transfer type and, in the fourth embodiment, when printing a full color image, a black image is first printed by the electrophotography type printer P1 and then images of the other colors are printed by the thermal transfer type printer P2. If the positions of the first printing mechanism P1 and the second printing mechanism P2 are reversed, the image that has been printed by the second printing mechanism P2 is destroyed by the heat applied by the fixing unit 167. For this reason, the second printing mechanism 12 is disposed downstream of the first fixing unit 167 of the first printing mechanism P1.

The second printing mechanism P2 is of much the same construction as the color image forming apparatus of the first embodiment except that the thermal head 36 is secured to the upper cover 166 and ink film ribbon differs in arrangement of colored inks. The thermal head 36 is movably supported by a support member 177 which is fixedly mounted to the upper cover 166. The upper cover 166 is mounted to the body and pivotal about a hinge 166*a* so that the upper cover 166 can be opened and closed with respect to the body. The ink film supply reel 32 and ink film takeup reel 33 are assembled in unitary construction. When the upper cover 166 is opened, the reels 32 and 33 and the image forming section 151 may be mounted to or dismounted from the body.

FIG. 15 illustrates an ink film ribbon 176 for use in the fourth embodiment. The ink film ribbon 176 has ink films of yellow, magenta, and cyan applied thereon.

Referring to FIG. 14, a paper feeding mechanism 180 is on the lower right side of the color image forming apparatus 150, and includes a paper cassette, paper pick-up mechanism, and registry roller. The paper cassette includes a paper tray 181, platform 182, and urging means 183. The paper pick-up mechanism includes a separator 184, spring 185, paper pick-up roller 186. The paper pick-up mechanism directs the print-medium 26 between the guides 187 and 188 to a first pinch roller 190 and then to a second pinch roller 191.

The first pinch roller 190 and second pinch roller 191 are in pressure contact with the feeding roller 189. Provided upstream of the first pinch roller 190 is a photosensor 192 which detects the leading end of the print-medium 26. A photosensor 193 is disposed downstream of the second pinch roller 191 and detects the leading end of the print-medium 26 to output a detection signal. The printing operation of the first printing mechanism P1 begins in timed relation to the detection signal.

The print-medium 26 can also be fed through a manually insertion tray 194 along a guide 195 into the apparatus. The manually inserted print-medium 26 is detected by the photosensor 196, transported by the feeding roller 189 and second registry roller 191 between the guides 197 and 198, arriving at the first printing mechanism P1 where a toner image is printed on the print-medium 26.

<Control system>

The control system of the fourth embodiment will be described with reference to FIG. 16. References Y, M, C, and K denotes image forming sections of the respective colors, i.e., yellow, magenta, cyan, and black. Referring to FIG. 16, the controller 201 is for example, a microprocessor and controls the overall operations of the color image forming apparatus 150. The controller 201 is connected to an SP bias power supply 202, DB bias power supply 203, charging power supply 204, and transferring power supply 205. The SP bias power supply 202 supplies electric power to a sponge roller 160 of the developing unit 157 in the image forming section 151. The DB bias power supply 203 supplies electric power to the developing roller 158 in the image forming section 151. The charging power supply 204 supplies electric power to the charging roller 156 in the image forming section 151. The transferring power supply 205 causes the transfer roller 153 in the image forming section 151 to be charged. The controller 201 controls the on and off operations of the respective power supplies.

The controller 201 is connected to a print controller 208K for the image forming section 151 of the first printing mechanism P1. The print controller 208K receives image data from a memory 209K and sends the received image data to an LED head 152 in response to the instruction from the controller 201 so as to control the time for which the LED head illuminates the photosensitive drum 154 to form an electrostatic latent image. The print controllers 208Y, 208M, and 208C are for controlling the thermal head 36 of the second printing mechanism P2 and receives image data from the memories 209Y, 209M, 209C, respectively. The print controllers 208Y, 208M, and 208C send these images to the thermal head 36 in response to the instructions from the controller 201 so as to control the time for which the thermal head 36 is energized, thereby fusing or sublimating the ink on the ink film ribbon 176 to print a color image on the print-medium 26. The memories 209Y, 209M, 209C, and 209K store the image data received via an interface 210 from an external apparatus.

The interface 210 separates the image data received from an external apparatus, for example, a host computer and stores yellow image data into the memory 209Y, magenta image data into the memory 209M, cyan image data into the memory 209C, and black image data into the memory 209K, respectively.

The fixing unit driver 211 controls the time for which the heater 170 is energized so as to maintain the surface temperature of the heat roller 168 in the fixing unit 167.

A motor driver 212 drives motors 213, 13, 19, 214, 216, and 217. The motor 213 drives the paper pick-up roller 186 in rotation. The motor 214 drives the photosensitive drum 154, charging roller 156, developing roller 158, sponge roller 160, transfer roller 153, feeding roller 189, and heat roller 168 of the fixing unit 167 in rotation. The platen motor 13 drives discharge rollers 38 and 39 in rotation. The platen motor 13 also drives the platen 10 of the second printing mechanism P2 in rotation in the direction shown by arrow A in FIG. 14. The motor 19 drives the rings 14 and 15 and fixed clamp member 16 of the second printing mechanism P2 in rotation. The motor 216 runs to feed the ink film ribbon from the ink film supply reel 32 to the ink film takeup reel 33. The motor 217 moves the thermal head 36 in the directions shown by arrows E and D. The rollers driven by the motors 213 and 214 are linked by belts or gears, not shown.

The sensor receiver/driver 218 drives the photosensors 20, 30, 192, 193, and 196 and receives the output waveforms of these photosensors and sends the waveforms to the controller 201. A magnet driver 219 drives the clamp driving mechanisms 22 and 23 for moving the clam member 21 into or out of contact engagement with the fixed clamp member 16.

<Operation>

The operation of the fourth embodiment will be described further with reference to F1GS. 17 and 18.

Figure 17:
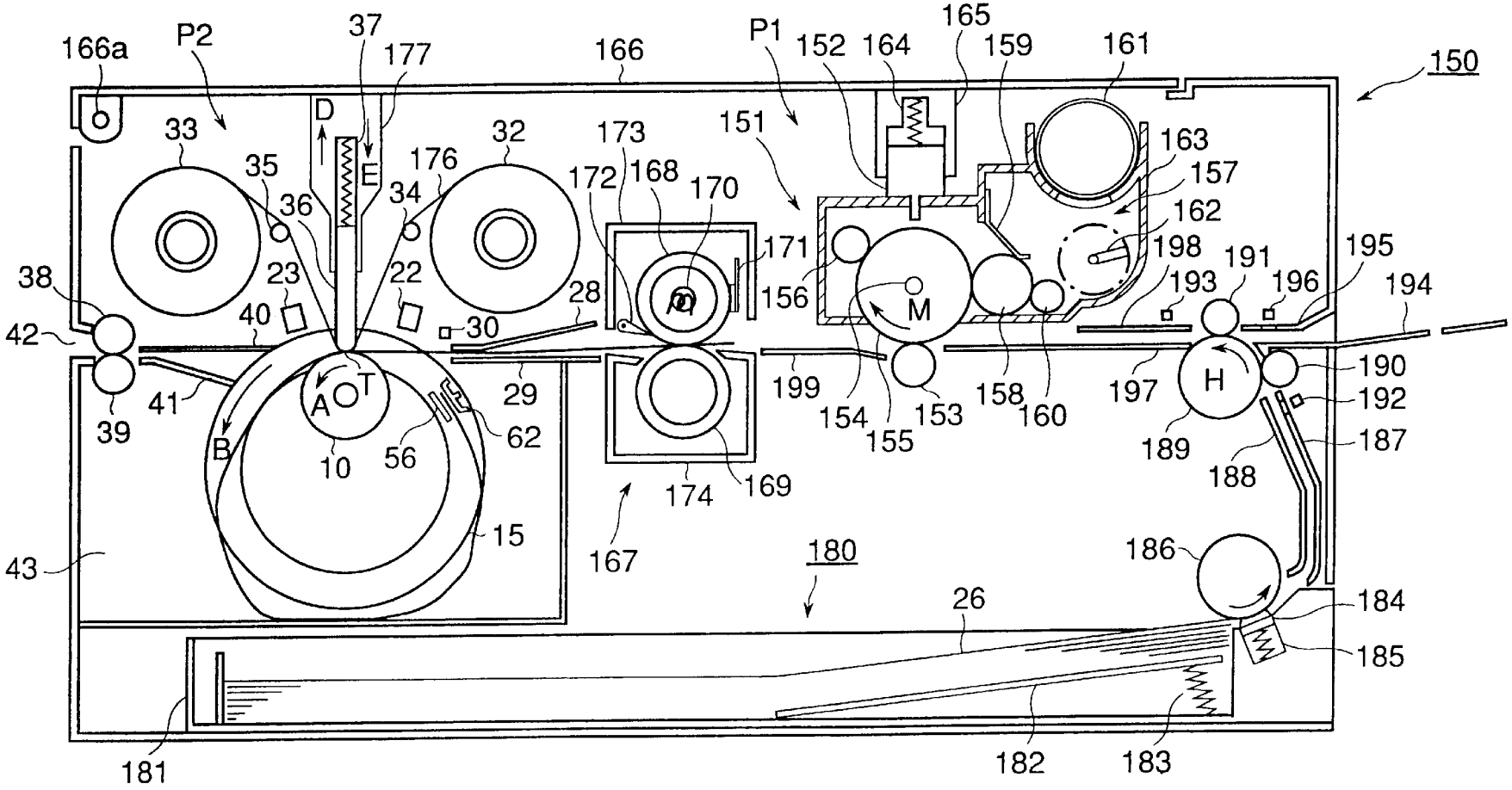
FIGS. 17 and 18 are side views illustrating the control system of the fourth embodiment.
Figure 18:
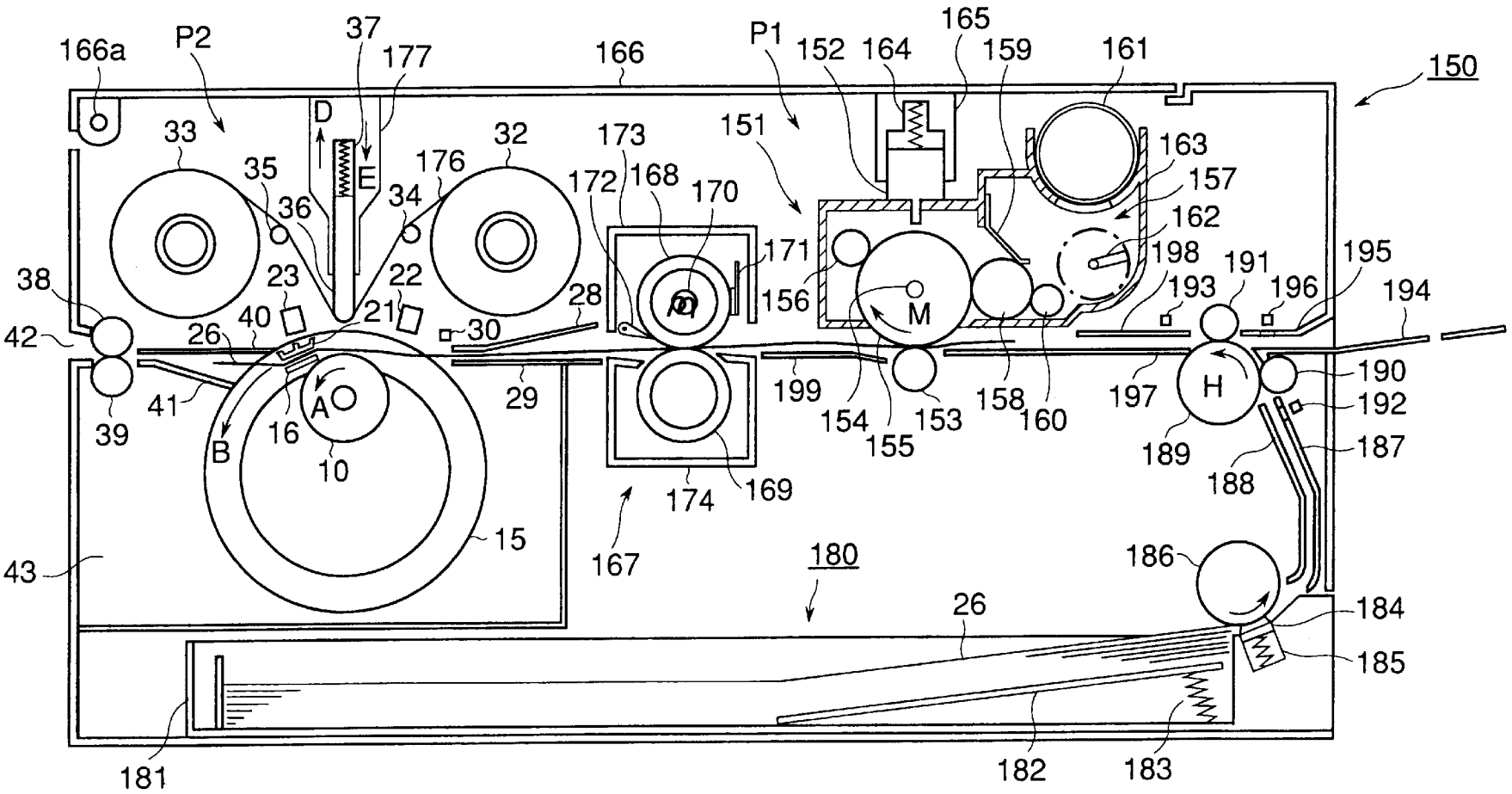

FIGS. 17 and 18 are side views illustrating the operation of the fourth embodiment. The operation will be described with respect to color printing.

Upon power up of the color image forming apparatus 150, a predetermined initialization is performed. Then, the controller 201 drives the fixing unit driver 211 to energize the heat roller 168 in the fixing unit 167, thereby warming up the heat roller 168 to a predetermined temperature. The controller 201 controls the heater 170 in the heat roller 168 to maintain the heat roller 168 at a predetermined temperature. During the warm-up of the fixing unit 167, the controller 201 drives the motor 19 to rotate the rings 14 and 15 and fixed clamp member 16 and movable clamp member 21 in the direction shown by arrow B, and to stop when the rings 14 and 15 and fixed clamp member 16 has rotated around the platen 10 to a position immediately under the clamp driving mechanism 22 where the home sensor 20 detects the home mark on the ring 15. The controller 201 causes the magnet driver 219 to activate the clamp driving mechanism 22 so that the camp member 21 moves out of contact engagement with the fixed clamp member 16 creating a gap between the movable clamp member 21 and fixed clamp member 16.

Thus, the initialization of the color image forming apparatus completes and the apparatus waits for image data which comes via the interface 210 from an external apparatus.

Upon receiving image data from an external apparatus such as host computer, the controller 201 sends instructions to interface 210 and the memories 209Y, 209M, 209C, and 209K, respectively. In response to the instruction, the interface 210 separates the image data according to color and sends image data of the respective colors into corresponding memories. That is, the memories 209Y, 209M, 209C, and 209K store yellow image data, magenta image data, cyan image data, and black image data, respectively. The image data stored in each memory is for one page of the print-medium 26.

<Operation of P1>

The operation of the first printing mechanism P1 will be described.

The controller 201 causes the motor driver 212 to drive the motor 213, thereby rotating the paper pick-up roller 186 so that the top page of the print-medium 26 in the paper tray 181 is advanced between the guides 187 and 188. The sensor 192 detects the leading end of the print-medium 26. The controller 201 then controls the motor driver 212 in such a way that the leading end of the print-medium 26 travels a short distance past the contact point between first pinch roller 190 and the feeding roller 189. Thus, the leading end is pressed between the feeding roller 189 and first pinch roller 190 so that a slack in the print-medium 26 will have therein, thereby eliminating skew of the print-medium 26.

The controller 201 causes the motor driver 212 to drive the motor 214, thereby rotating the photosensitive drum 155 of the first printing mechanism P1, charging roller 156, developing roller 158, sponge roller 160, transfer roller 153, feeding roller 189, heat roller 168 of the fixing unit 167. The feeding roller 189 rotates in the direction shown by arrow H, so that the print-medium 26 is transported by the first and second pinch rollers 190 and 191 between the guides 197 and 198. The controller 201 causes the sensor receiver/driver 218 to drive the photosensor 193, thereby detecting the leading end of the print-medium 26. After the trailing end of the print-medium 26 has passed the separator 184, the controller 201 causes the motor driver 212 to stop the motor 213.

When the photosensor 193 detects the leading end of the print-medium 26, the controller 201 turns on the charging power supply 204, DB bias power supply 203, SP bias power supply 202 in order to supply voltages to the charging roller 156, developing roller 158, and sponge roller 160, respectively. As a result, the surface of the photosensitive drum 155 of the first printing mechanism P1 is uniformly charged by the charging roller 156, and the sponge roller 160 and developing roller 158 are charged by predetermined high voltages.

Then the controller 201 outputs an instruction to the memory 209K in order to send the black image data for one line from the memory 209K to the print controller 208K. The print controller 208K reforms the image data received from the memory 209K into a data form which the LED head 152 can handle. The LED head 152 causes the LEDs in accordance with the received image data to form an electrostatic latent image for one line on the charged surface of the photosensitive drum 155. In this manner, the black image data which is sent line by line from the memory 209K is formed into an electrostatic latent image line by line on the surface of the photosensitive drum 155 till the black image data for one page has been formed into an electrostatic latent image.

The electrostatic latent image on the surface of the photosensitive drum 155 is developed with black toner supplied from the developing roller 158 into a toner image. When the leading end of the print-medium 26 has arrived between the photosensitive drum 155 and the transfer roller 153, the controller 201 turns on the transferring power supply 205, the toner image on the photosensitive drum 155 being transferred to the print-medium 26 with the aid of Coulomb force. As the photosensitive drum 155 rotates, the toner image is transferred line by line to the print-medium 26 till the black image for one page has been transferred to the print-medium 26. Thus, the first printing mechanism P1 completes the transfer of the black toner image to the print-medium 26. When the trailing end of the print-medium 26 reaches the contact point between photosensitive drum 155 and the transfer roller 153, the controller 201 turns off the transferring power supply 205 and charging power supply 204.

Then, the print-medium 26 is guided by a guide 199 to the fixing unit 167 where the toner image on the print-medium 26 is fused by the pressure roller 169 and the heat roller 168 that has reached a temperature sufficient for fixing.

The print-medium 26 that has passed through the fixing unit 167 is then guided by the guides 28 and 29 to the second printing mechanism P2. The photosensor 30 detects the leading end of the print-medium 26 and the print-medium 26 further travels a predetermined distance with respect to the detection of the leading end of the print-medium 26 so that the leading end enters the gap between the movable clamp member 21 and fixed clamp member 16. Then, the clamp driving mechanism is activated to clamp the leading end of the print-medium 26. After clamping, the controller 201 causes the motor driver 212 to drive the motor 217 so that the up/down mechanism moves the thermal head 36 in the direction shown by arrow D away from the platen 10. Then, the controller 201 drives the platen motor 13 and motor 19 in order to rotate the platen 10 in the direction shown by arrow A and the rings 14 and 15 in the direction shown by arrow B. The platen 10 and rings 14 and 15 rotate at the same peripheral speed as when the print medium 26 passes through the first printing mechanism P1.

<Operation of P2>

When the movable clamp member 21 has passed between the thermal head 36 and the platen 10, the up/down mechanism moves the thermal head 36 in the direction shown by arrow E so that the heat generating elements of the thermal head 36 moves into pressure engagement with the platen 10 with the ink film ribbon and the print-medium 26 sandwiched between the platen 10 and the thermal head 36. The motor 216 is driven to supply the ink film ribbon 176 from the ink film supply reel 32 to the ink film takeup reel 33, thereby starting printing operation of yellow image. The motor 214 continues to run to drive the heat roller 168 in rotation. When the sensor 30 detects the trailing end of the print-medium 26, the controller 201 causes the motor driver 212 to stop the motor 214, thereby stopping the printing operation of the first printing mechanism P1. At the same time as the motor 214 stops, the controller 201 turns off the charging power supply 204, SP bias power supply 202, DB bias power supply 203 of the first printing mechanism P1. 1f the print-medium 26 is long, it will have a large slack as shown in FIG. 17.

When the printing operation of yellow image has completed, the printing operation of a magenta image will begin. Reference is made to the first embodiment for specific operation.

Finally, the printing operation of cyan image is performed. For printing operation of cyan image, the print-medium 26 will not travel around the platen 10, but advances directly toward the discharge rollers 38 and 39 after the thermal head 36 prints the cyan image on the print-medium 26.

The timing of starting a printing operation in the second printing mechanism P2 depends on when the photosensor 30 detects the leading end of the print-medium 26 and when the home sensor 20 detects the home mark on the ring 15. Thus, the image printed by the first printing mechanism P1 can be registered accurately and precisely with the image printed by the second printing mechanism P2. The movable clamp member 21 can be set at exactly the same position at any print, cycle, and therefore registration problem will not occur between yellow, magenta, and cyan images in the second printing mechanism P2.

<Monochrome printing>

The monochrome printing, i.e., only black image will now be described. The specific printing operation has been described above and therefore only transportation of the print-medium 26 will be described.

When printing only a black image, the motor 217 is driven to move the thermal head 36 moves in the direction shown by arrow D so that the thermal head 36 moves out of contact engagement with the platen 10. The motor 19 is driven to rotate the rings 14 and 15 and fixed clamp member 16 and movable clamp member 21 in the direction shown by arrow B, so that the home sensor 20 detects the home mark on the ring 15 and outputs a detection signal via the sensor receiver/driver 218 to the controller 201. The controller 201 causes the magnet driver 219 to activate the clamp driving mechanism 22 so that the movable clamp member 21 moves out of contact engagement with the fixed clamp member 16 to create a gap between the movable clamp member 21 and fixed clamp member 16.

With this condition, the print-medium 26 having a fixed black image thereon is guided between the guides 28 and 29 to the first printing mechanism P2. The sensor 30 detects the leading end of the print-medium 26 and the print-medium 26 is transported further a predetermined distance from the detection of its leading end, the print-medium 26 entering the gap between the clamp 21 and fixed clamp member 16. The controller 201 causes the magnet driver 219 to cause the clamp driving mechanism 22, thereby closing the gap between the clamp 21 and fixed clamp member 16 to firmly clamp the leading end of the print-medium 26 therebetween.

The controller 201 causes the motor driver 212 to drive the rings 14 and 15 in the direction shown by arrow B. When movable clamp member 21 arrives at a position immediately under the clamp driving mechanism 23, the motor 19 is halted to stop the rings 14 and 15, i.e., movable clamp member 21. Then, the controller 201, activates the clamp driving mechanism 23 which causes the movable clamp member 21 to move out of contact engagement with the fixed clamp member 16, creating a gap between the movable clamp member 21 and fixed clamp member 16. With this condition, heat roller 168 continues to rotate and the discharge rollers 38 and 39 direct the leading end of print-medium 26 between the guides 40 and 41 and then through the print-medium exit.

When the trailing end of the print-medium 26 has passed the gap between the fixed clamp member 16 and movable clamp member 21, the controller 201 causes the clamp driving mechanism 23 to deactivate and causes the motor driver 212 to drive the motor 19 so that the rings 14 and 15 rotate in a direction opposite to the direction shown by arrow B. When the movable clamp member 21 has traveled around the platen 10 to a position immediately under the clamp driving mechanism 22, the controller 201 causes the motor 19 to stop, thereby halting the rings 14 and 15, i.e., the movable clamp member 21. Then, the controller 201 activates the clamp driving mechanism 22 so that the movable clamp member 21 moves out of contact engagement with the fixed clamp member 16 and waits for the next print-medium 26. In this manner, after having an image data printed on the print-medium 26, the print-medium 26 is clamped and transported to the print-medium exit 42 one after the other.

It is to be noted that the transport path from the fixing unit 167 to the discharge rollers 38 and 39 is slightly longer than the full length of the print-medium 26.

The aforementioned monochrome printing may also be performed in a similar manner for a manually inserted print-medium 26. This case will now be described.

The user places a print-medium 26 into the manual insertion tray 194. Upon receiving an output of the photosensor 196 via the sensor receiver/driver 218, the controller 201 causes the motor driver 212 to drive the motor 214, thereby rotating the feeding roller 189, and the photosensitive drum 155, charging roller 156, developing roller 158, sponge roller 160, transfer roller 153, and heat roller 168. The feeding roller 189 rotates in the direction shown by arrow H, and the print-medium 26 is transported by the second pinch roller 191 through the guides 197 and 198 to the first printing mechanism P1. The rest of the operation is the same as that previously described.

The aforementioned fourth embodiment offers the following advantages.

The printing operation of black images is actually most frequently performed. A thermal transfer type printer offers excellent color print results. In the fourth embodiment, the printing operation of black images is performed by an electrophotographic printer while expensive, less frequently performed color printing is performed by the thermal type printer. This saves running cost of the image forming apparatus significantly. In performing monochrome printing, the first printing mechanism P1 prints black images and the movable clamp member of the second printing mechanism transports the print-medium 26 to the print-medium exit, thereby implementing high speed monochrome printing.

The second printing mechanism P2 is of a thermal fusion type or sublimation type and therefore heat builds up in the thermal head when the thermal head is energized. In order to prevent heat build-up in the thermal head, some amount of time should be allowed for the thermal head to be sufficiently cooled down. However, this slows down the printing speed. Even conventional high speed full color printer takes about three minutes to print one page of A4 size, that is, about one minute for each color. On the other hand, the first printing mechanism P1 of an electrophotographic type is at least as fast as 4 to 6 ppm (page per minute), and takes only about 10 to 15 seconds for one page of A4 size. In other words, printing speeds vary depending on the types of printer.

Fifth Embodiment

In the fourth embodiment, the printing speed of the first printing mechanism P1 is decreased when performing color printing operation so that the first and second printing mechanisms are of the same speed. As a result, the print-medium 26 travels the shortest possible transport path, thereby implementing a high speed color printing. Thus, when performing monochrome printing, the overall printing speed is much higher. 1However, providing the first printing mechanism P1 of an electrophotography type printer with two different speeds needs a speed selecting means of switching between high speed for monochrome printing and low speed for color printing. Different printing speeds result in different amount of charges with which the toner in the developing unit is charged, requiring switching means for selecting proper developing bias voltage and the transfer voltage. This makes the apparatus more expensive and the overall construction will involve more factors which induce unstable operations of the apparatus.

A fifth embodiment solves the aforementioned drawbacks.

<Construction>

Figure 19:
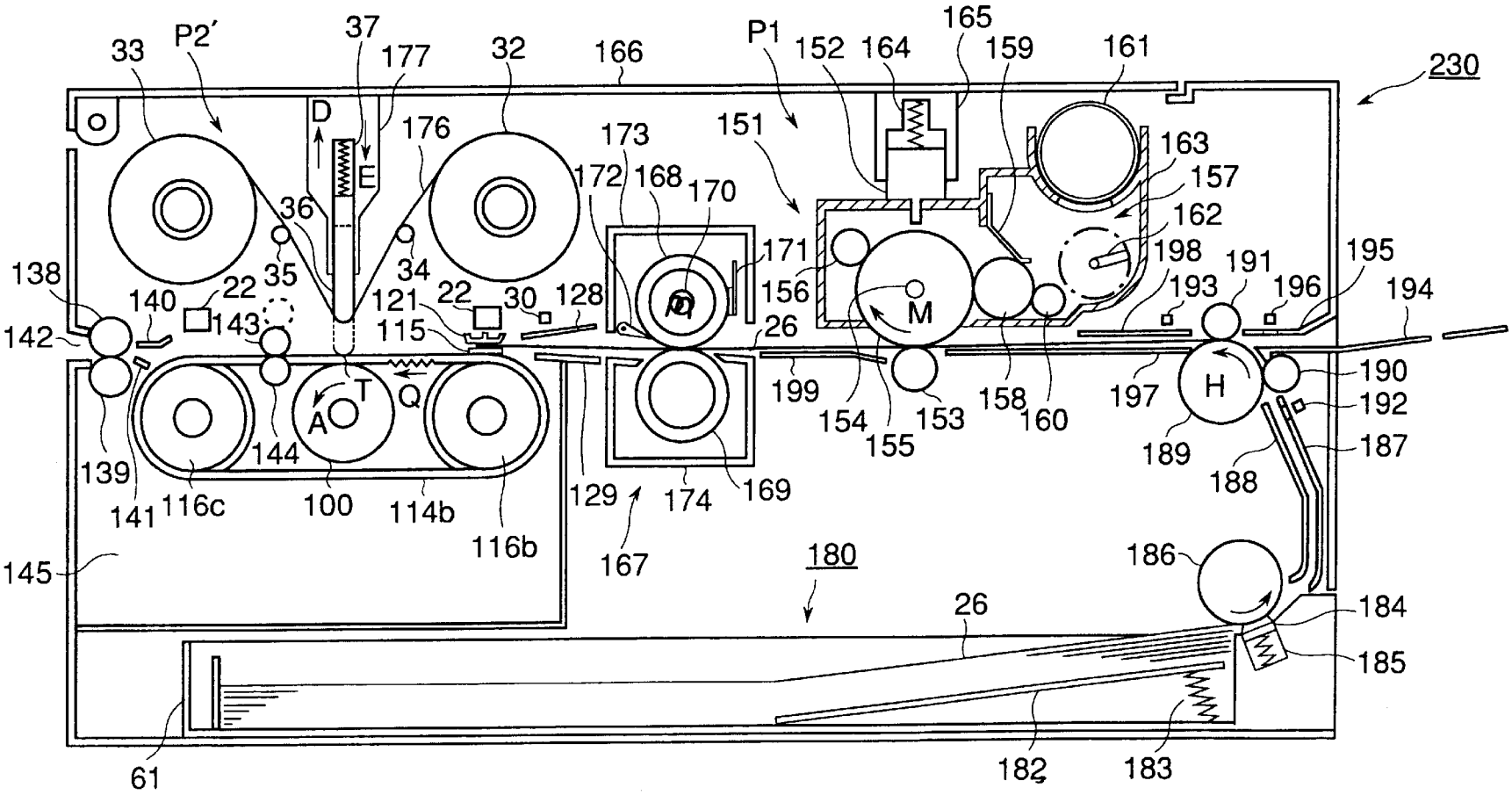
FIG. 19 is a side view of a color image forming apparatus according to the fifth embodiment.

The fifth embodiment will be described with reference to FIG. 19. FIG. 19 is a side view of a color image forming apparatus according to the fifth embodiment. The fifth embodiment will be described with respect to a case where the first printing mechanism P1 prints faster than the second printing mechanism P2.

Referring to FIG. 19, a color image forming apparatus 230 includes a first printing mechanism P1 of the same construction as in the fourth embodiment and a second printing mechanism P2' of the same construction as in the third embodiment. The first and second printing mechanisms P1 and P2' are aligned in order from the print-medium insertion side to the discharge side. The paper feeding mechanism 180, fixing unit 167, etc., are the same as those in the fourth embodiment. The elements corresponding to those in the third and fourth embodiments have been given the same references and description thereof is omitted. The ink film ribbon 176 used in the second printing mechanism P2' is the same as that in the fourth embodiment with yellow, magenta, and cyan as shown in FIG. 15.

<Operation>

The operation of the fifth embodiment will be described in detail. The first printing mechanism P1, paper feeding mechanism 180, and fixing unit 167, and other transport path and elements for transporting the print-medium 26 are the same as those in the fourth embodiment and the description thereof is omitted. Thus, description is made mainly for the second printing mechanism P2' referring to FIG. 13A (third embodiment) as required.

As in the fourth embodiment, the fixing unit 167 is first initialized. The controller drives the motor 119 in rotation so that the timing belts 114*a* and 114*b* and fixed clamp member 115 and movable clamp member 121 are rotated in the direction shown by arrow Q. The fixed clamp member 115 and movable clamp member 121 stop at a home position where the fixed clamp member 115 and movable clamp member 121 are directly under the clamp driving mechanism 22 and the home sensor 120 detects the home mark on the fixed clamp member 115. With the fixed clamp member 115 and movable clamp member 121 positioned at the home position, the clamp driving mechanism 22 is activated so that the movable clamp member 121 moves out of contact engagement with the fixed clamp member 115 creating a gap between the movable clamp member 121 and fixed clamp member 115.

The print-medium 26 passes through the first printing mechanism P1 where a toner image is transferred and fused, and is then guided between the guides 128 and 129. The sensor 30 detects the leading end of the print-medium 26 and outputs a detection signal. The print-medium 26 is further advanced a predetermined distance in response to the detection signal. When the leading end of the print-medium 26 enters the gap between the movable clamp member 121 and fixed clamp member 115, the controller activates the clamp driving mechanism 22 which moves to the movable clamp member 121 to clamp the leading end of the print-medium 26. After clamping, a driving mechanism, not shown, causes the pinch roller 143 to move to the dotted line position shown in FIG. 19. Then, the controller causes the up/down mechanism to move the thermal head 36 in the direction shown by arrow D to the solid line position shown in FIG. 19 so that the thermal head 36 is out of contact engagement with the platen 100.

Then, the controller causes the platen motor 113 and motor 119 to rotate so that the platen 100 rotates in the direction shown by arrow A and the timing belts 114*a* and 114*b* run in the direction shown by arrow Q. The peripheral speeds of the timing belts 114*a* and 114*b* and the platen 100 are the same speed as the first printing mechanism P1 (i.e., at a high speed). When the fixed clamp member 115 and movable clamp member 121 has passed the pinch rollers 143 and 144, a driving mechanism, not shown, moves the pinch roller 143 to the solid line position shown in FIG. 19, the pinch rollers 143 and 144 rotating in such a direction that the print-medium 26 travels in the direction shown by arrow Q.

The platen 100 rotates in the direction shown by arrow A and the movable clamp member 121 runs in the direction shown by arrow Q around the platen 100. When the movable clamp member 121 arrives at the pulleys 116*b* and 116*d*, the motor 119 is halted so that only the clamp 121 is halted. The platen 100 continues to rotate in the direction shown by arrow A, and the print-medium 26 is transported by the pinch rollers 143 and 144 in the direction shown by arrow Q, having a slack therein in the space 145 of the apparatus. When the trailing end of the print-medium 26 has passed the pinch rollers 143 and 144, the platen motor 113 is halted and the pinch roller 143 is returned to the dotted line position in FIG. 19. When the sensor 30 detects the trailing end of the print-medium 26, all of operations of the first printing mechanism P1 and fixing unit 167 are stopped.

After the first printing mechanism P1 completes its printing operation, the second printing mechanism P2' will begin color printing.

The controller causes the platen motor 113 and motor 119 to drive the platen 100 in the direction shown by arrow A and the timing belts 114*a* and 114*b* in the direction shown by arrow Q, respectively. When the movable clamp member 121 has passed the gap between the thermal head 36 and the platen 100, the up/down mechanism move the thermal head 36 in the direction shown by arrow E to the dotted line position where the heat generating elements of the thermal head is in pressure contact with the platen 100 with the ink film ribbon 176 and the print-medium 26 sandwiched between the thermal head 36 and the platen 100. The ink film ribbon is fed from the ink film supply reel 32 to the ink film takeup reel 33, thereby beginning the printing operation of yellow image.

During the printing operation, at the same time as the ink film ribbon 176 is fed from the ink film supply reel 32 to the ink film takeup reel 33, the controller drives the platen motor 113 and the motor 119, thereby rotating the platen 100 in the direction shown by arrow A and timing belts 114*a* and 114*b* in the directions shown by arrow Q. When the movable clamp member 121 has passed the gap between the pinch rollers 143 and 144, the pinch roller 143 is moved to the solid line position in FIG. 19. Since the print-medium 26 is applied a tension thereon, the ink can be easily come off the ink film ribbon 176 to the print-medium 26.

Then, printing operation is continued, i.e., the platen 100 rotates in the direction shown by arrow A, the movable clamp member 121 runs in the direction shown by arrow Q, and the thermal head 36 thermally transfers the ink to the print-medium 26. When the movable clamp member 121 has traveled to the pulleys 116*b* and 116*d*, the controller causes the motor 119 to stop, thereby stopping the movable clamp member 121. On the other hand, the platen 100 is still rotated in the direction shown by arrow A still carrying out printing operation. Thus, the print-medium 26 having the ink thermally transferred thereon will have a slack therein within the space 145 of the apparatus 230. When the trailing end of the print-medium 26 has arrived at the area T, the up/down mechanism causes the thermal head 36 to move in the direction shown by arrow D so that the thermal head 36 is out or contact engagement with the platen 100, completing the printing operation. As described above, the print-medium 26 is transported at a constant speed by the platen 100, preventing drift in speed at which the print-medium 26 is transported. Then, the belts 14*a* and 14*b* run again so that the movable clamp member 121 again runs in the direction shown by arrow Q.

When the movable clamp member 121 has passed the gap between the thermal head 36 and the platen 100, the up/down mechanism causes the thermal head 36 to move in the direction shown by arrow E to the dotted line position in FIG. 19 where the heat generating elements of the thermal head 36 are in pressure contact with the platen with the ink film ribbon 176 and the print-medium 26 sandwiched between the thermal head 36 and platen 100. Then, the ink film ribbon 176 is fed from the ink film supply reel 32 to the ink film takeup reel 33, thereby beginning the printing operation for a magenta image. The printing operation of a magenta image is the same as that of the yellow image and the description thereof is omitted.

Finally, printing operation of a cyan image is performed. When the movable clamp member 121 has passed the gap between the thermal head 36 and platen 100, the up/down mechanism causes the thermal head 36 to move in the direction shown by arrow E to the dotted line position in FIG. 19 where the heat generating elements of the thermal head 36 are in pressure contact with the platen 100 with the ink film ribbon 176 and the print-medium 26 sandwiched between the thermal head 36 and platen 100. Then, the controller causes the platen 100 to rotate in the direction shown by arrow A while also feeding the ink film ribbon from the ink film supply reel 32 to the ink film takeup reel 33, thereby beginning the printing operation for a cyan image. When the movable clamp member 121 passes the gap between the pinch rollers 143 and 144 after having started the printing operation of the cyan image, the controller causes the pinch roller 143 to move to the solid line position shown in FIG. 19. The printing operation is still continued and when the movable clamp member 121 has traveled around the platen 100 to a position directly under the clamp driving mechanism 23, the controller causes the motor 119 to stop, thereby stopping the timing belts 114*a* and 114*b*, i.e., the movable clamp member 121. Then, the controller activates the clamp driving mechanism 23 so that the movable clamp member 121 moves out of contact engagement with the fixed clamp member 115 creating a gap between the fixed clamp member 115 and the movable clamp member 121 to disable the clamping. The printing operation still continues so that the print-medium 26 is guided between the guides 140 and 141 to the discharge rollers 138 and 139. The discharge rollers 138 and 139 transport the print-medium 26 while at the same time the printing operation of the cyan image is performed on the print-medium 26. When the print-medium 26 is completely discharged by the discharge rollers 138 and 139 through the print-medium exit 142, all the printing operations complete.

<Monochrome printing>

The monochrome printing operation (black image) will now be described. The operation will be primarily described with respect to the transportation of the print-medium 26 when the first printing mechanism P1 performs the monochrome printing operation.

When printing only a black image, the pinch roller 143 is held at the dotted position in FIG. 19, and the up/down mechanism moves the thermal head 36 in the direction shown by arrow D, and then the thermal head 36 is held at a position where the thermal head 36 is out of contact engagement with the platen 100. In addition, the motor 119 is driven to move the fixed clamp member 115 and the movable clamp member 121 in the direction shown by arrow Q to a home position where the home sensor 120 detects the home mark on the timing belts 114*a* and 114*b*. Then, the controller activates the clamp driving mechanism 22 to move the movable clamp member 121 out of contact engagement with the fixed clamp member 115 creating a gap between the fixed clamp member 115 and the movable clamp member 121.

Then, the print-medium 26 having a toner image transferred thereto passes through the fixing unit 167 and is guided between the guides 128 and 129 to the second printing mechanism P2'. The photosensor 30 detects the leading end of the print-medium 26 and outputs a detection signal. The print-medium 26 is then advanced a predetermined distance in response to the detection signal till the leading end of the print-medium 26 enters the gap between the fixed clamp member 115 and the movable clamp member 121.

The controller deactivates the driving mechanism 22 to move the clamp 121 into contact engagement with the fixed clamp member 115, thereby clamping the leading end of the print-medium 26. Then, the controller causes the motor 119 to drive the timing belts 114*a* and 114*b* to run in the direction shown by arrow Q, and when the movable clamp member 121 has arrived at the home position directly under the clamp driving mechanism 23, the controller stops the motor 119, thereby halting the timing belt 114*a* and 114*b*, i.e., the movable clamp member 121. Then, the controller activates the clamp driving mechanism 23, so that the movable clamp member 121 moves out of contact engagement with the movable clamp member 121 to create a gap between the movable clamp member 121 and fixed clamp member 115, thus disabling clamping.

The heat roller 168 and discharge rollers 138 and 139 continue to rotate, and the print-medium 26 is guided between the guides 140 and 141 to the discharge rollers 138 and 139 then discharged through the print-medium exit 142. When the print-medium 26 has passed between the fixed clamp member 115 and movable clamp member 121, the controller deactivates the clamp driving mechanism 23 and drives the motor 119 to rotate in order to run the timing belts 114*a* an 114*b* in the direction shown by arrow Q. When the movable clamp member 121 has traveled around the platen 100 to the home position directly under the clamp driving mechanism 22, the controller stops the motor 119, thereby stopping the timing belts 114*a* and 114*b*, i.e., the movable clamp member 121. Then, the controller activates the clamp driving mechanism 22 in order to cause the movable clamp member 121 to move out of contact engagement with the fixed clamp member 115, thereby preparing for the next print-medium 26. The aforementioned operations are repeated for each page of print-medium 26 so that the first printing mechanism P1 discharges printed pages one after the other.

Just as in the fourth embodiment, the print-medium 26 inserted from the manual insertion tray 194 can of course be printed in the same manner.

The fifth embodiment offers the following advantages. When performing a color printing, a black image is printed as fast as the monochrome printing operation, and the movable clamp member 121 is also driven at the same peripheral speed as the first printing mechanism P1. Once the print-medium 26 is pulled into the second printing mechanism P2, the movable clamp member 121 is driven at a lower peripheral speed so that the second printing mechanism P2' can normally print colored images. Thus, there is no need for a two-mode speed control to provide for printing a black image in the monochrome printing and printing a black image in the color printing. This eliminates means for switching the drive means and means for switching high voltage power supplies, implementing an inexpensive apparatus. Eliminating a two-mode speed control of the first printing mechanism P1 yields reliable operation of the first printing mechanism P1.

Sixth Embodiment

<Construction>

Figure 20:
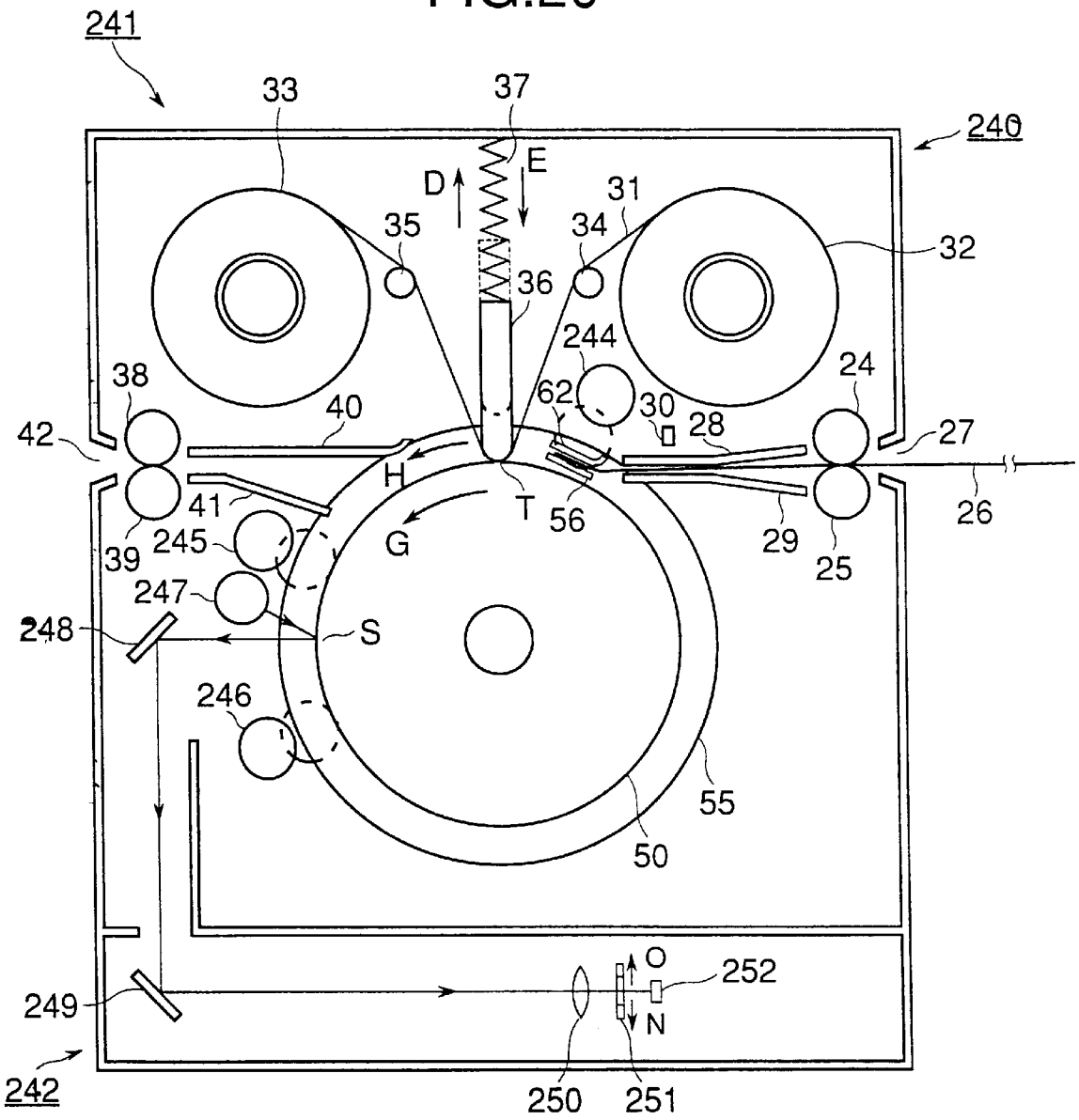
FIG. 20 is a side view of a color image forming apparatus according to the sixth embodiment.

The present invention is not limited to the aforementioned preferred first to fifth embodiments and may be varied in many ways. For example, the present invention is applicable not only to an apparatus having a color printing function but also to an apparatus having an image reading function, i.e., scanner which reads information printed on the medium. A sixth embodiment is directed to an image forming apparatus having a function of a scanner. FIG. 20 is a side view of a color image forming apparatus according to the sixth embodiment.

Referring to FIG. 20, a color image input and output apparatus 240 according to the sixth embodiment includes a color image forming section 241 and a color reading section 242. The color image forming section 241 includes a platen 50, discs 54 and 55 (only 55 is shown), fixed clamp member 56, movable clamp member 62, and clamp driving plate 64 and 65, all being the same as those shown in FIG. 9 (second embodiment). The motors for driving these structural elements are also the same as those shown in FIG. 9. The thermal head 36, ink film ribbon 31, ink film supply reel 32, ink film takeup reel 33 are also the same as those in the first embodiment. Disposed around the platen 50 are pinch rollers 244, 245, and 246. The pinch rollers 244–246 are adapted to move into and out of contact engagement with the platen 50.

The color reading section 242 includes a fluorescent lamp 247, mirrors 248 and 249, condenser lens 250, filter 251, and image sensor 252. The fluorescent lamp 247 illuminates an original at an area S between the pinch rollers 245 and 246 to read the original. The platen 50 rotates in a direction shown by arrow G and the discs 54 and 55 rotate in a direction shown by arrow H. The filter 251 is moved in the directions shown by arrows N and O by a moving mechanism, not shown.

<Printing operation>

Figure 21:
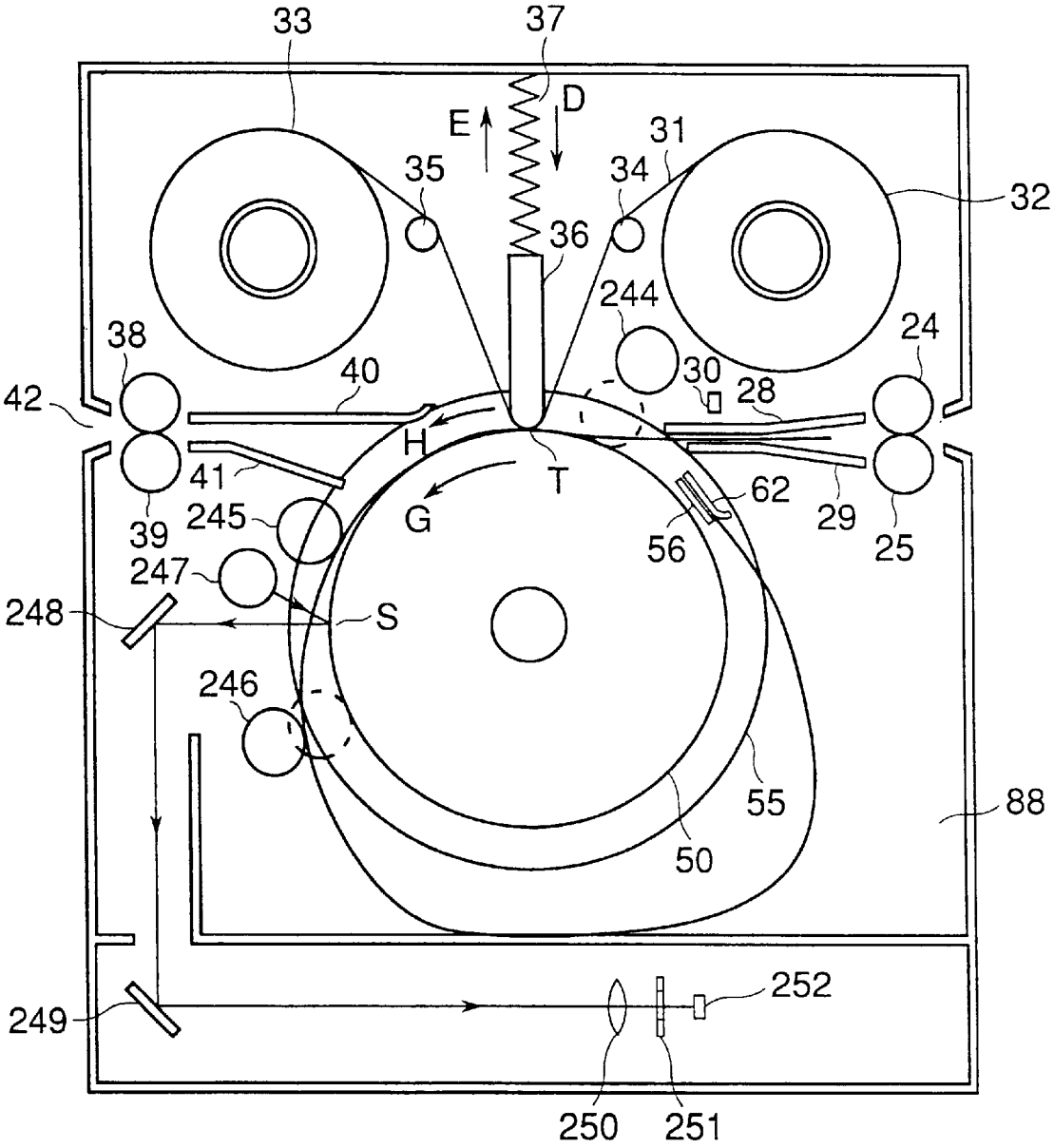
FIGS. 21 and 22 are side views illustrating the sixth embodiment.
Figure 22:
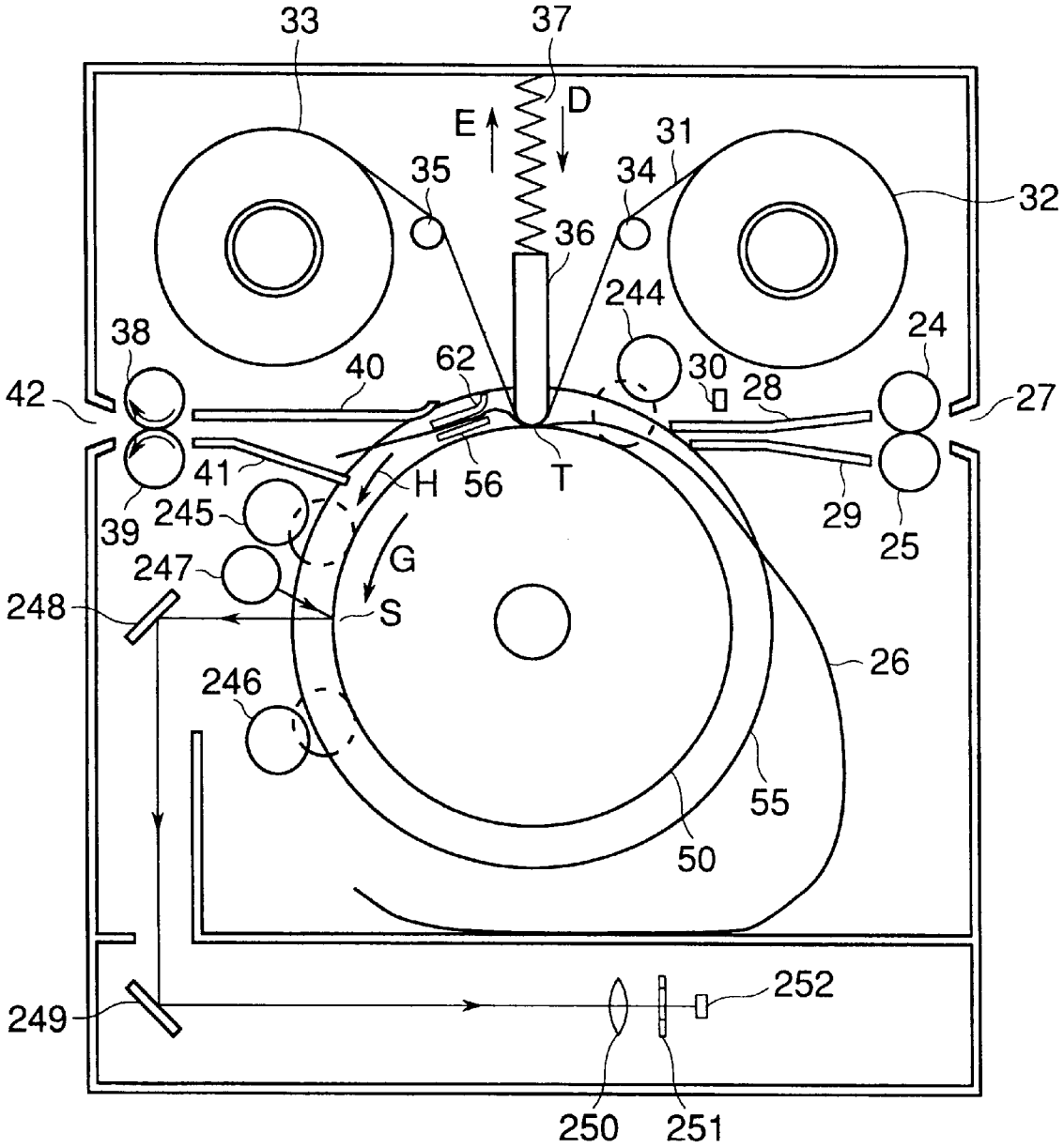

The operation of the sixth embodiment will now be described. First, printing operation will be described with reference to FIGS. 21 and 22. FIGS. 21 and 22 are side views illustrating the sixth embodiment. FIG. 9 is also referred as required.

First, the pinch rollers 244, 245, and 246 are moved out of contact engagement with the platen 50. Then, the discs 54 and 55 are rotated in the direction shown by arrow H and are stopped at a home position where the home sensor 66 detects the movable clamp member 62. At, the home position, the clamp driving plates 64 and 65 are moved toward each other, thereby moving the movable clamp member 62 out of contact engagement with the fixed clamp member 56. When the print-medium 26 is inserted into the apparatus, the sensor 30 detects the leading end of the print-medium 26 and the print-medium 26 is further advanced a predetermined distance with respect to the detection of the leading end so that the leading end enters the gap between the movable clamp member 62 and fixed clamp member 56. At this time point, the transportation of the print-medium 26 is halted.

The controller causes the clamp driving plate 64 and 65 to slide away from each other so that the movable clamp member 62 clamps the print-medium 26. Then, the thermal head 36 is moved out of contact engagement with the platen 50 and the platen 50 is rotated in the direction shown by arrow G and the discs 54 an 55 are rotated in the direction shown by arrow H. When the movable clamp member 62 has passed between the thermal head 36 and the platen 50, the thermal head 36 is lowered into pressure contact with the platen 50, the ink film ribbon 31 and print-medium 26 being sandwiched between the thermal head 36 and the platen 50. This initiates the printing operation of an yellow image. The movable clamp member 62 travels around the platen 50 and when the movable clamp member 62 has passed the pinch roller 245, the pinch roller 245 is moved into pressure contact engagement with the platen 50 and then the printing operation of the yellow image continues. As the printing operation goes on, the print-medium 26 will have a slack therein shown in FIG. 21.

As described above, the printing operations of yellow, magenta, and cyan images are carried out just as in he second embodiment. Finally, the printing operation of a black image is performed. For the printing operation of black image, the controller causes the clamp driving plates 64 and 65 to disable the clamping after the clamp 62 has passed between the thermal head 36 and the platen 50, thereby discharging the print-medium 26 as soon as the images have been printed thereon. This completes the entire printing operation.

<Original-reading operation>

Figure 23:
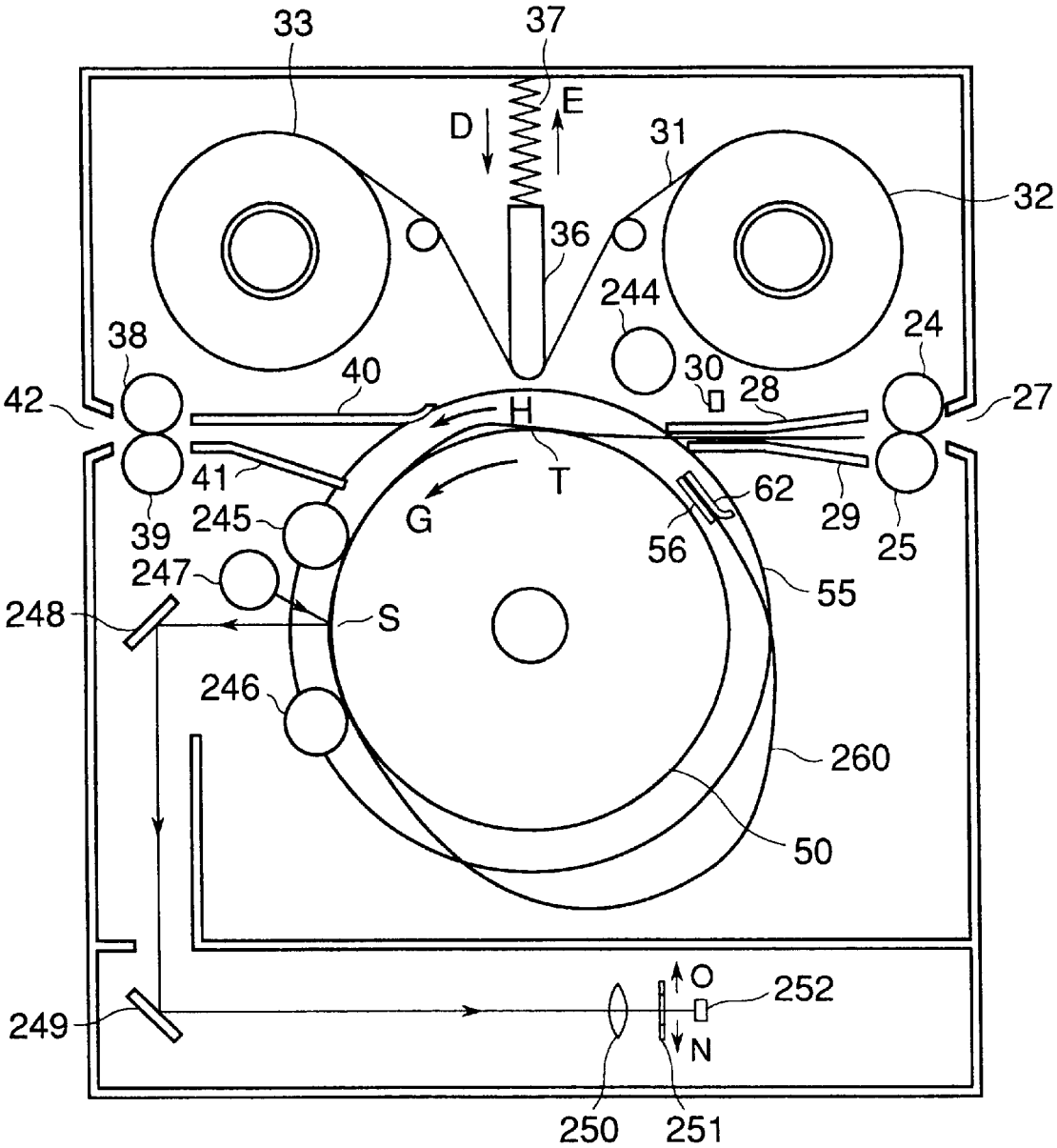
FIGS. 23 and 24 are side views illustrating the original-reading operation according to the sixth embodiment.
Figure 24:
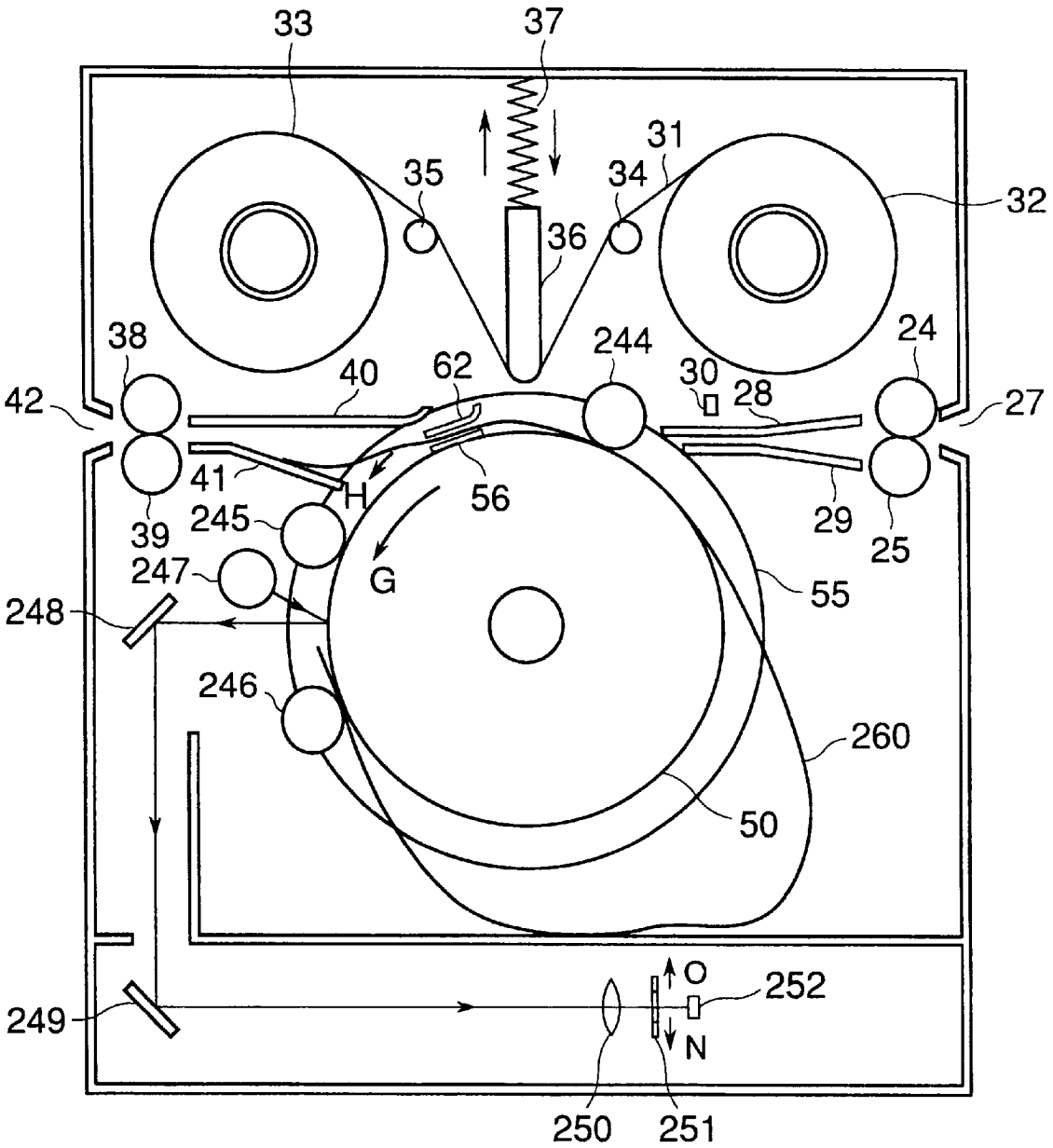

The original-reading operation will now be described with reference to FIGS. 23 and 24. FIGS. 23 and 24 are side views illustrating the original-reading operation according to the sixth embodiment.

Referring to FIG. 23, the thermal head 36 is moved in the direction shown by arrow E so that the thermal head 36 is out of contact engagement with the platen 50. The pinch rollers 244, 245, and 246 are moved out of contact engagement with the platen 50. Then, the fixed clamp member 56 and movable clamp member 62 travel around the platen 50 to the home position and stops at the home position. The movable clamp member 62 is moved out of contact engagement with the fixed clamp member 56, creating a gap therebetween. Then, an original 260 is inserted through a print-medium entrance 27 and sensor 30 detects the leading end of the original 260 and output a detection signal. The original 260 is then advanced further a predetermined distance with respect to the detection signal so that the leading end of the original 260 enter the gap between the fixed clamp member 56 and the movable clamp member 62 and is clamped therebetween.

Thereafter, the controller causes the platen 50 and discs 54 and 55 to rotate in the directions shown by arrows G and H, respectively. When the movable clamp member 62 has passed an area T under the thermal head 36 and then between the pinch roller 245 and platen 50, the pinch roller 245 is moved into pressure contact with the platen 50 while at the same time the fluorescent lamp 247 is turned on. The movable clamp member 62 is further rotated around the platen 50 and when the image part on the original 260 arrives at a point S where the fluorescent lamp 247 illuminates the original 260, the reading operation of the first color (red) begins. The feeding rollers 24 and 25 are rotated during the reading operation of the first color of the original 260 and are stopped when the trailing end of the original 260 has passed the sensor 30. The image read from the original 260 is sent to the image sensor 252 via the mirrors 248 and 249, condenser lens 250, and filter 251.

The image sent to the sensor 252 includes a plurality of lines scanned in the lateral direction (perpendicular to the direction of travel of the original) of the original 260, the plurality of lines being aligned side by side in the direction of travel of the original 260, and sent to the sensor 252 in synchronism with the peripheral speed of the platen 50, i.e., the speed at which the original 260 is advanced. The image is stored in a memory, not shown.

The platen 50 and discs 54 and 55 continue to be rotated to advance the original 260, the discs 54 and 55 rotating slightly faster than the platen 50. The torque limiter 61 slips if a load greater than a predetermined value is imposed on the discs 54 and 55, ensuring a predetermined tension on the original 260 so that the original 260 travels at the same speed as the peripheral speed of the platen 50. The original-reading operation still goes on and when the movable clamp member 62 has passed between the pinch roller 246 and platen 50, the pinch roller 246 moves into pressure contact with the platen 50 as shown in FIG. 23. Thus, the original 260 remains sandwiched between the platen 50 and pinch roller 240 during transportation of the original 260, and the fluorescent lamp 247 illuminates the surface of the original 260 between the pinch rollers 245 and 246.

The original 260 is further transported till the movable clamp member 62 traveling around the platen 50 arrives and is halted at a home position immediately before the guides 28 and 29. The platen 50 continues to rotate so that the reading operation is carried on, producing a slack in the original 260 under the platen 50 in FIG. 23. When the trailing end of the original 260 arrives at a position S where the original 260 is read, the controller causes the pinch rollers 245 and 246 to move out of contact engagement with the platen 50, completing the reading operation of the first color. As described above, the original 260 runs together with the platen 50 during the reading operation. This ensures that the original 260 runs at a constant speed, eliminating drift in the transport speed of the original 260.

The reading operations of the second color (green) and third color (blue) are the same as the reading operation of the first color and the description thereof is omitted. The filter 251 is displaced in directions shown by arrows M and N depending on the color to read.

In reading the third color, when the trailing end of the original 260 has passed the position where the original 260 is read, the movable clamp member 62 is rotated in the direction shown by arrow H. Then, when the movable clamp member 62 has passed the pinch roller 244, the controller causes the pinch roller 244 to move into pressure contact with the platen 50. When the movable clamp member 62 further travels around the platen 50 to a point just before the guides 40 and 41, the movable clamp member 62 is halted and is moved out of contact, engagement with the fixed clamp member 56. Thus, the original 260 is released as shown in FIG. 24, and is guided between the guides 40 and 41 to the print-medium exit 42.

If the original 260 has a length in the direction of travel shorter than the circumference of the platen 50, the movable clamp member 62 rotates without stopping till the reading operation completes, requiring a shorter time in reading the original 260.

The home sensor 66 (FIG. 9) detects the movable clamp member 62 and outputs a detection signal when the movable clamp member 62 arrives at the home position and the reading operation starts with respect to the detection signal outputted from the home sensor 66. This ensures that the images of the respective colors are accurately superposed without registration problem.

In the sixth embodiment, the original 260 travels around the platen 50 when reading the original 260. The travel path of the original 260 is the same as the path in which the print-medium 26 travels during printing operation. This construction eliminates the need for an exclusive travel path for the original 260 and lends itself to a miniaturization of the apparatus. When the original 260 has a length longer than the circumference of the platen 50, the original 260 can have a slack therein as it travels around the platen 50 in the apparatus, being advantageous in miniaturizing the apparatus.

The present invention is not limited to the aforementioned embodiments and various modifications may be made. While the color printing operations in the embodiments have been described with respect to the thermal transferring using the thermal head, a multilayer thermal color printing material may be used which has layers of capsule of magenta, cyan, and yellow (and black) formed one over the other on a base body so that, the thermal head directly heats the capsules and the thermally printed material is subjected to fixing under ultraviolet light. Alternatively, a multilayer thermal color printing material may be used which has layers of capsules of magenta, cyan, and yellow (and black) formed one over the other on a base body, and light emitted from LEDs directly illuminate the surface of the capsules to optically record information thereon and the optically recorded medium is subjected to pressure fixing.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image forming apparatus, comprising:

a rotating platen;

a medium holding section, holding a leading end of a print medium;

a rotary transporting section driven in rotation independently of said rotating platen, said rotary transporting section supporting said medium holding section thereon and rotating to guide said medium holding section to travel around said platen in such a manner that the print-medium rotates together with said platen, said medium holding section traveling in a loop-like path which is shorter than a maximum dimension of the print-medium in a direction of travel of the print-medium; and a color image recording head movable into pressure engagement with said platen with the print-medium sandwiched between said platen and said color image recording head, said color image recording head printing images of a predetermined plurality of colors in sequence and in register on the print-medium;

wherein when said color image recording head is printing each of the images, said rotary transporting section rotates until said medium holding section reaches a position immediately before said color image recording head and then halts, said platen continuously rotating before and after said medium holding section has halted so that, after the recording medium has been printed with the respective images, the recording medium leaves said platen and has slack in a region thereof that extends between the medium holding section and the color image recording head.

2. The image forming apparatus of claim 1, wherein said loop-like path is a circular path concentric with the platen.

3. The image forming apparatus of claim 2, wherein said rotary transporting section includes two rings spaced apart, the two rings rotating about a common rotational axis which extends in parallel to a rotational axis of the platen, and said medium holding section extends across the two rings.

4. The image forming apparatus of claim 1, where in said loop-like path is a noncircular path.

5. The image forming apparatus of claim 4, wherein said rotary transporting section includes two belts spaced apart, each of the two belts running in a plane perpendicular to the platen, and said medium holding section extends across the two belts.

6. The image forming apparatus of claim 1, wherein said medium holding section includes a fixed clamp member and a movable clamp member, said medium holding section holding the print-medium between the fixed clamp member and the movable clamp member when the movable clamp member moves toward the fixed clamp member, and releasing the print-medium when the movable clamp member moves away from the fixed clamp member.

7. The image forming apparatus of claim 1, wherein and said loop-like path is a circular path eccentric with the platen.

8. The image forming apparatus of claim 7, wherein said rotary transporting section includes two rings spaced apart, the two rings rotating about a common rotational axis which extends in parallel to a rotational axis of the platen, and said medium holding section extends across the two rings.

9. The image forming apparatus of claim 1, further including a guide member defining a space which accommodates the slack produced in the print-medium when the print-medium has a length longer than the loop-like path.

10. The image forming apparatus of claim 9, wherein said guide member is movable so as to vary a size of the space.

11. The image forming apparatus of claim 1, further including a tension applying section for applying a predetermined tension to the print-medium between said medium holding section and the platen when said color recording section is moved into pressure engagement with the platen.

12. The image forming apparatus of claim 11, wherein the platen rotates in a same direction as said rotary transporting section, and said tension applying section allows said rotary transporting section to rotate at a higher peripheral speed than the platen till the tension reaches a predetermined value, and to subsequently rotate at such a speed as to maintain the tension at the predetermined value.

13. The image forming apparatus of claim 1, wherein said rotary transporting section causes said medium holding section to start traveling from a home position thereof when printing an image of a corresponding color, said rotary transporting section causing said medium holding section to travel around the platen and come to a halt at the home position, said medium holding section remaining halted at the home position till the image of the corresponding color has been printed.

14. The image forming apparatus of claim 13, wherein said medium holding section releases the leading end of the print-medium when said color image recording section starts recording an image of a final color on the print-medium and the leading end of the print-medium passes said part of the surface of the platen, the print-medium being subsequently directed to an exit.

15. The image forming apparatus of claim 1, further including a monochrome image recording section which prints a black image on the print-medium.

16. The image forming apparatus of claim 15, wherein said monochrome image recording section is an electrophotographic printer;

wherein an image of black is printed by said electrophotographic printer at a first speed and images of other colors are printed by said color image recording section at a second speed, the first speed being higher than the second speed.

17. The image forming apparatus of claim 15, wherein said monochrome image recording section is an electrophotographic printer and is located upstream of said color image recording section;

wherein an image of black is printed by said monochrome image recording section and subsequently images of yellow, magenta, and cyan are printed by said color image recording section and in register with the image of black printed by said monochrome image recording section.

18. The image forming apparatus of claim 15, wherein said monochrome image recording section prints a black image on the print-medium, and said rotary transporting section rotates to a first position where said medium holding section holds a print-medium by clamping the leading end of the print-medium on which the black image has been printed by said monochrome image recording section, and then to a second position where said medium holding section releases the leading end of the print-medium so that the print-medium travels toward an exit.

19. The image forming apparatus of claim 1, further comprising an image reading section located to oppose the platen where the print-medium slides over the platen, said print-medium passing between said image reading section and the platen.

20. The image forming apparatus of claim 19, further including a tension applying section for applying a predetermined tension to the print-medium.

21. The image forming apparatus of claim 20, wherein the platen rotates in a same direction as said rotary transporting section, and said tension applying section allows said rotary transporting section to rotate at a higher peripheral speed than the platen till the tension reaches a predetermined value, and to subsequently rotate at such a speed as to maintain the tension at the predetermined value.

22. A color image forming apparatus, comprising:

an electrophotographic recording section which prints a black image on a print-medium at a first printing speed; and a thermal recording section located downstream of said electrophotographic recording section with respect to a direction of travel of the print-medium, said thermal recording section printing at least one of yellow, magenta, and cyan images on the print-medium at a second printing speed lower than the first printing speed;

wherein said thermal recording section comprises:

a rotating platen;

a medium holding section holding a leading end of the print medium;

a rotary transporting section rotatable selectively at a first rotational speed, and at a second rotational speed that is lower than the first rotational speed, and being driven in rotation independently of said rotating platen, said rotary transporting section supporting said medium holding section thereon and rotating to guide said medium holding section to travel around said platen in such a manner that the print-medium rotates together with the platen, said medium holding section traveling in a loop-like path which is shorter than a maximum dimension of the print-medium in a direction of travel of the print-medium; and a color image recording head movable into pressure engagement with said platen with the print-medium sandwiched between said platen and said color image recording head, said color image recording head printing the at least one of yellow, magenta, and cyan images on the print-medium at the second printing speed;

wherein when said color image recording head is printing the at least one of yellow, magenta, and cyan images, said rotary transporting section rotates until said medium holding section reaches a position immediately before said color image recording head and then halts while said platen continues to rotate before and after said medium holding section has halted so that the recording medium leaves said platen and becomes unsupported after the recording medium has been printed with the at least one of yellow, magenta, and cyan images; and wherein when said electrophotographic recording section prints the black image on the print-medium and subsequently said thermal recording section prints the at least one of yellow, magenta, and cyan images in registration with the black image on the print-medium, said medium holding section holds the leading end of the print-medium that is being discharged from said electrophotographic recording section, and said platen and said rotary transporting section rotate at the first rotational speed to guide the print medium so that the print-medium enters said thermal recording section at the first printing speed, said rotary transporting section halting at the position immediately before said color image recording head while said platen continues to rotate after said medium holding section has halted so that the recording medium leaves said platen, said thermal recording section starting to print the at least one of yellow, magenta, and cyan images on the print-medium at the second printing speed by rotating said platen and rotary transporting section at the second rotational speed after the print-medium has completely entered said thermal recording section from said electrophotographic recording section.

23. A color image forming apparatus, comprising:

an electrophotographic recording section which prints a black image on a print-medium at a first printing speed; and a thermal recording section located downstream of said electrophotographic recording section with respect to a direction of travel of the print-medium, said thermal recording section printing images of a predetermined plurality of colors in sequence and in register on the print-medium at a second printing speed lower than the first printing speed;

wherein said thermal recording section comprises:

a rotating platen;

a medium holding section, holding a leading end of the print-medium;

a rotary transporting section driven in rotation independently of said rotating platen, said rotary transporting section supporting said medium holding section thereon and rotating to guide said medium holding section to travel around said platen in such a manner that the print-medium rotates together with said platen, said medium holding section traveling in a loop-like path which is shorter than a maximum dimension of the print-medium in a direction of travel of the print-medium; and a color image recording head movable into pressure engagement with said platen with the print-medium sandwiched between said platen and said color image recording head, said color image recording head printing images of a plurality of colors on the print-medium at the second printing speed, the color images being printed in sequence and in register with each other;

wherein when said color image recording head is printing each of the images, said rotary transporting section rotates until said medium holding section reaches a position immediately before said color image recordings head and then halts while said platen continues to rotate until each of the images has been printed, said platen continuing to rotate after said medium holding section has halted so that the recording medium leaves said platen and has slack in a region thereof that extends between the medium holding section and the color image recording head.

24. The color image forming apparatus of claim 23, wherein said loop-like path is a noncircular path.

25. The color image forming apparatus of claim 24, wherein said rotary transporting section includes two belts spaced apart, each of the two belts running in a plane perpendicular to the platen, and said medium holding section extends across the two belts.

26. The color image forming apparatus of claim 23, wherein said medium holding section includes a fixed clamp member and a movable clamp member, said medium holding section holding the print-medium between the fixed clamp member and the movable clamp member when the movable clamp member moves toward the fixed clamp member, and releasing the print-medium when the movable clamp member moves away from the fixed clamp member.

27. The color image forming apparatus of claim 23, wherein said loop-like path is a circular path eccentric with the platen.

28. The color image forming apparatus of claim 27, wherein said rotating section includes two rings spaced apart, the two rings rotating about a common rotational axis which extends in parallel to a rotational axis of the platen, and said medium holding section extends across the two rings.

29. The color image forming apparatus of claim 23, wherein said electrophotographic recording section prints a black image on the print-medium, and said rotary transporting section transports said medium from a first position where said medium holding section holds a print-medium by clamping the leading end of the print-medium on which the black image has been printed by said electrophotographic recording section to a second position where said medium holding section releases the leading end of the print-medium so that the print-medium travels toward an exit.

* * * * *